US005915953A

United States Patent [19]

Mifune et al.

[11] Patent Number: 5,915,953

[45] Date of Patent: Jun. 29, 1999

[54] CATALYST MEMBER FOR A LIGHTER AND PROCESS FOR PRODUCING THE SAME

[75] Inventors: Hideo Mifune; Noriyuki Serizawa; Masato Seki; Shinichi Okawa; Jun Kashiwagi, all of Shizuoka-ken, Japan

[73] Assignee: Tokai Corporation, Kanagawa-ken, Japan

[21] Appl. No.: 08/515,827

[22] Filed: Aug. 16, 1995

[30] Foreign Application Priority Data

Aug. 19, 1994 [JP] Japan ..... 6-195233

[51] Int. Cl.[6] ..... F23Q 11/00; F23Q 7/12

[52] U.S. Cl. ..... 431/268; 431/255; 502/300; 502/349; 502/355; 502/327

[58] Field of Search ..... 502/66, 305, 300, 502/349, 355, 325, 326, 327; 428/469, 472; 431/132, 136, 268, 147, 258, 131, 255

[56] References Cited

U.S. PATENT DOCUMENTS

| | | | |
|---|---|---|---|
| 3,873,262 | 3/1975 | Porgrell | 431/255 |
| 4,941,818 | 7/1990 | Ohe et al. | 431/268 |
| 5,278,113 | 1/1994 | Ono et al. | 502/66 |

FOREIGN PATENT DOCUMENTS

| | | | |
|---|---|---|---|
| 55-65828 | 5/1980 | Japan | 431/255 |

*Primary Examiner*—Steven Bos
*Attorney, Agent, or Firm*—Baker & Botts, LLP

[57] ABSTRACT

A catalyst member for a lighter comprises a linear base material, and a fusion bonding material, which is constituted of a material selected from the group consisting of a powdered metal and a vitreous fused material. A finely divided catalyst carrier, which is constituted of a metal oxide, is secured to the surface of the linear base material by the fusion bonding material. A catalyst is deposited on the surface of the finely divided catalyst carrier.

12 Claims, 14 Drawing Sheets

COIL PITCH VS. RE-LIGHTING PERCENTAGE
(0.1% CHLOROPLATINIC ACID SOLUTION x THREE TIMES)

NUMBER OF TURNS VS. RE-LIGHTING PERCENTAGE
(0.1% CHLOROPLATINIC ACID SOLUTION x ONE TIME)

SPACE BETWEEN ADJACENT TURNS
VS. RE-LIGHTING PERCENTAGE
(0.1% CHLOROPLATINIC ACID SOLUTION x ONE TIME)

SPACE BETWEEN ADJACENT TURNS
VS. RE-LIGHTING PERCENTAGE
(0.1% CHLOROPLATINIC ACID SOLUTION x TWO TIMES)

CATALYST MEMBER FOR A LIGHTER AND PROCESS FOR PRODUCING THE SAME

BACKGROUND OF THE INVENTION

1. Field of the Invention

This invention relates to a catalyst member for a lighter, such as a gas lighter for smoker's requisites or a pilot burner. This invention also relates to a process for producing the catalyst member for a lighter.

2. Description of the Prior Art

Techniques for lighters, such as gas lighters, have heretofore been proposed, wherein a catalyst member is located in the vicinity of a fire outlet formed at a top end of a combustion cylinder. With the proposed techniques, in cases where a flame is blown off by wind and goes out, even if a lighting operation is not carried out again by the user, re-lighting effects can be obtained with the catalyst, the temperature of which has risen to a temperature not lower than the lighting temperature due to the previous combustion. One of such techniques is disclosed in, for example, Japanese Unexamined Patent Publication No. 60(1985)-101419.

Catalytic gas lighters have also been proposed, wherein a platinum wire having a coiled shape or one of the other shapes is located as the catalyst member such that a flame may come into contact with the platinum wire. With such catalytic gas lighters, even if a flame is blown off by wind and goes out, a fuel gas will come into contact with the platinum wire, the temperature of which has risen. The fuel gas can thus be lighted again by the platinum wire.

Also, as the combustion catalyst member, it is considered to locate a flat plate-shaped catalyst member in a combustion cylinder. The flat plate-shaped catalyst member may be made by forming a porous ceramic material or a fibrous ceramic material into a paper sheet-like shape or a plate-like shape, dip coating the paper sheet- or plate-like material with a catalyst solution, such as a chloroplatinic acid solution, thermally decomposing the dip coated layer, and thereby forming platinum particles on the paper sheet- or plate-like material.

Further, as for a platinum wire having a coiled shape, which is utilized as the catalyst member (catalyst wire) in a catalytic gas lighter, such that the lighting performance of the catalyst wire may be enhanced, catalyst wires having various dimensions and shapes have been proposed. For example, in Japanese Unexamined Patent Publication No. 2(1990)-178519, a catalytic fire outlet for a lighter is disclosed, which is provided with a coiled catalyst wire having a wire diameter falling within the range of 0.10 mm to 0.25 mm, a coil outer diameter falling within the range of 1.0 mm to 2.0 mm, and the number of turns falling within the range of 6 to 10. Also, Japanese Unexamined Utility Model Publication No. 3(1991)-71257 discloses a gas combustion catalyst for a lighter, which has an elliptic coiled shape and in which a diameter of a wire material falls within the range of 0.8 mm to 0.20 mm, a coil longer diameter falls within the range of 1.8 mm to 2.8 mm, a coil shorter diameter falls within the range of 0.8 mm to 1.8 mm, the number of turns falls within the range of 3 to 6, and a coil pitch falls within the range of 0.4 mm to 1.0 mm. Further, Japanese Unexamined Utility Model Publication No. 3(1991)-121353 discloses a gas combustion catalyst for a lighter, which has a circular coiled shape and in which a diameter of a wire material falls within the range of 0.8 mm to 0.20 mm, a coil outer diameter falls within the range of 1.4 mm to 2.2 mm, and a coil pitch falls within the range of 0.4 mm to 1.0 mm.

However, the platinum wire, which is ordinarily used as the catalyst member in the gas lighters, or the like, in which a fuel gas can be lighted again with the catalyst member, is very expensive. Therefore, in cases where the platinum wire is used as the catalyst member, the problems occur in that the cost of the gas lighter cannot be kept low. Accordingly, it is difficult to use the expensive platinum wire in gas lighters which must be cheap, such as disposable gas lighters.

Specifically, in order for a platinum wire to constitute a catalyst member, it is necessary to use a platinum wire having a diameter of approximately 1.0 mm and a length of approximately 35 mm. The weight of the platinum wire having such a size is as large as approximately 5.9 mg, and therefore the material cost by itself becomes high. Also, in cases where the platinum wire is used as the catalyst member, only the surface of the platinum wire, which comes into contact with a gas flame flow, can exhibit a catalytic reaction, and the region inward from the surface of the platinum wire cannot contribute as the catalyst. Also for this reason, the amount of platinum used cannot be kept small.

With the catalyst member comprising a carrier, which is constituted of the flat plate-shaped porous ceramic material or the flat plate-shaped fibrous ceramic material, a fuel gas burns at the position of the catalyst member, and no flame is obtained at a position above a combustion cylinder. Therefore, the problems occur in that sufficient functions for lighters cannot be obtained.

Specifically, the effects of the catalyst in lighters are that, at the time at which a combustion flame has been blown off by wind and has gone out, the catalyst has been heated to a temperature not lower than a temperature, at which a catalytic combustion reaction of the fuel gas can occur, and the catalyst can again light a subsequent gas flow. Also, in cases where the lighter is used for lighting cigarettes, or the like, or for other purposes, it is desirable that a fuel gas burns with a flame at the top end of the combustion cylinder in order to facilitate the lighting of cigarettes, or the like.

When a fuel gas burns with a flame at the top end of the combustion cylinder, it often occurs that the flame is blown off by wind and goes out. In such cases, the catalyst automatically re-lights cigarettes, or the like, in the manner described above. However, with the flat plate-shaped catalyst member described above, the volume of the catalyst member located at the top end of the combustion cylinder becomes large. Therefore, when most of the gas flow comes into contact with the catalyst member, the gas undergoes the catalytic combustion at the reaction temperature of the catalyst at the position of the catalyst. As a result, the combustion with red heat of the catalyst proceeds, and combustion with a flame cannot be obtained at the top end of the combustion cylinder.

In order for the combustion with a flame to be obtained, it is necessary that the contact area of the catalyst member is small with respect to a gas flow. In such cases, most of the gas flow passes through the position of the catalyst without coming into contact with the catalyst and burns at a position above the top end of the fire outlet, and the combustion with a flame is thereby obtained. At this time, a portion of the gas flow comes into contact with the catalyst and undergoes catalytic combustion, and the temperature of the catalyst member is thereby kept at a temperature not lower than the catalytic reaction temperature. Therefore, even if the flame at the region of the combustion with the flame is blown off by wind and goes out, the fuel gas can be lighted again by the catalyst. Also for this reason, the linear catalyst member constituted of a platinum wire is used ordinarily, and a structure is employed wherein the linear catalyst member is located with a small area appropriate with respect to the gas flow area in a combustion cylinder. For example, as for platinum or platinum alloy catalyst members employed in ordinary gas lighters, a wire having a diameter falling within the range of approximately 0.1 mm to approximately 0.2 mm is coiled so as to have a coil diameter of approximately 2.5 mm and a length of a coiled part falling within the range of approximately 3 mm to approximately 5 mm and is used in this form.

Further, with the porous, flat plate-shaped catalyst member described above, the heat capacity of the catalyst member becomes large and, as a result, the drop in the temperature of the catalyst after the fire has been extinguished becomes slow. Therefore, there is the risk that a gas, which has leaked from the fuel gas tank of the lighter, is lighted by the catalyst member after the fire has been extinguished. Specifically, if the heat capacity of the catalyst member is large, a long time will be required for the temperature of the catalyst member to drop to a temperature not higher than the temperature, at which the oxidation reaction of the fuel gas begins, after the fire has been extinguished. In such cases, there is the risk that a leakage gas, a residual gas, or a gas, which has leaked from the fuel gas tank of the lighter due to an erroneous actuation of a gas lever when the lighter is accommodated in a pocket of the user, comes into contact with the hot catalyst member is thereby lighted again.

The re-lighting characteristics of a catalyst wire also vary in accordance with the dimensions and the shape of the catalyst wire. However, with the conventional catalyst wires having the dimensions and the shapes described above, a sufficient re-lighting performance cannot always be obtained. Thus a need exists for an even further improvement in the dimensions and the shape of a catalyst wire.

SUMMARY OF THE INVENTION

The primary object of the present invention is to provide a catalyst member for a lighter, in which the amount of an expensive catalyst metal used is reduced, and which enables a fuel gas to burn with a flame, has a small heat capacity, and is suitable for use in a disposable gas lighter having a low cost.

Another object of the present invention is to provide a process for producing the catalyst member for a lighter.

A further object of the present invention is to provide a catalyst member for a lighter, which has specific dimensions and a specific shape and has good re-lighting performance over a large number of re-lighting operations.

The present invention provides a catalyst member for a lighter, comprising:

i) a linear base material, ii) a fusion bonding material, which is constituted of a material selected from the group consisting of a powdered metal and a vitreous fused material, iii) a finely divided catalyst carrier, which is constituted of a metal oxide and is secured to the surface of the linear base material by the fusion bonding material, and iv) a catalyst, which is deposited on the surface of the finely divided catalyst carrier.

In the catalyst member for a lighter in accordance with the present invention, the linear base material should preferably be constituted of a nickel-chrome alloy wire. Also, the powdered metal, which serves as the fusion bonding material, should preferably be selected from the group consisting of a mixed powder of nickel powder and chrome powder; a mixed powder of nickel powder, chrome powder, and a rare earth metal; and a mixed powder of nickel powder, chrome powder, and metallic silicon. Further, the vitreous fused material, which serves as the fusion bonding material, should preferably be a fused powder glass. Furthermore, the finely divided catalyst carrier should preferably be constituted of fine alumina particles, or mixed powder of fine alumina particles and titanium oxide. In particular, in cases where the finely divided catalyst carrier is constituted of the mixed powder of fine alumina particles and titanium oxide, the proportion of the titanium oxide should preferably fall within the range of 10% by weight to 45% by weight with respect to the fine alumina particles.

In cases where the linear base material is constituted of a nickel-chrome alloy wire, fine particles, which are selected from the group consisting of nickel oxide powder, chromium oxide powder, and mixed powder of nickel oxide and chromium oxide, may be fusion bonded to the surface of the linear base material, which is constituted of the nickel-chrome alloy wire, by the fusion bonding material, which is selected from the group consisting of a mixed powder of nickel and chrome; a mixed powder of nickel, chrome, and a rare earth metal; and a mixed powder of nickel, chrome, and metallic silicon, and the fusion bonded fine particles, which are selected from the group consisting of nickel oxide powder, chromium oxide powder, and mixed powder of nickel oxide and chromium oxide, may constitute the finely divided catalyst carrier.

The present invention also provides a catalyst member for a lighter, comprising:

i) a linear base material, ii) a catalyst carrier, which is formed on the surface of the linear base material and is constituted of fine metal particles, the fine metal particles being constituted of a powdered metal having been fusion bonded to the surface of the linear base material, and iii) a catalyst, which is deposited on the surface of the catalyst carrier.

In the last-mentioned catalyst member for a lighter in accordance with the present invention, the linear base material may be constituted of a nickel-chrome alloy wire, and the fine metal particles, which are fusion bonded to the surface of the linear base material, may be selected from the group consisting of a mixed powder of nickel and chrome; a mixed powder of nickel, chrome, and a rare earth metal; and a mixed powder of nickel, chrome, and metallic silicon.

The present invention further provides a process for producing a catalyst member for a lighter, comprising the steps of:

i) fusion bonding a finely divided catalyst carrier, which is constituted of a metal oxide, to the surface of a linear base material by a fusion bonding material, which is constituted of a material selected from the group consisting of a powdered metal and a vitreous fused material, ii) applying a catalyst solution to the surface of the finely divided catalyst carrier, and iii) thermally decomposing the catalyst solution, which has been applied to the surface of the finely divided catalyst carrier, a catalyst being thereby deposited on the surface of the finely divided catalyst carrier.

In the process for producing a catalyst member for a lighter in accordance with the present invention, the catalyst solution may be an aqueous chloroplatinic acid solution. Also, as the catalyst, besides platinum, it is possible to employ a known catalyst material, such as palladium or rhodium.

The present invention still further provides a catalyst member for a lighter, comprising a coiled portion and fitting portions, which extend from opposite ends of the coiled portion, wherein the length of a linear material, which constitutes the coiled portion and the fitting portions, falls within the range of 35 mm to 50 mm, a coil outer diameter of the coiled portion falls within the range of 2.5 mm to 3.5 mm, and the number of turns in the coiled portion falls within the range of 3 to 5.5.

The present invention also provides a catalyst member for a lighter, comprising a coiled portion and fitting portions, which extend from opposite ends of the coiled portion, wherein the length of a linear material, which constitutes the coiled portion and the fitting portions, falls within the range of 35 mm to 50 mm, a coil outer diameter of the coiled portion falls within the range of 2.5 mm to 3.5 mm, and a coil pitch in the coiled portion falls within the range of 0.7 mm to 1.4 mm.

The present invention further provides a catalyst member for a lighter, comprising a coiled portion and fitting portions, which extend from opposite ends of the coiled portion, wherein the length of a linear material, which constitutes the coiled portion and the fitting portions, falls within the range of 35 mm to 50 mm, a coil outer diameter of the coiled portion falls within the range of 2.5 mm to 3.5 mm, and a space between adjacent turns in the coiled portion falls within the range of 0.4 mm to 0.9 mm.

The present invention still further provides a catalyst member for a lighter, comprising a coiled portion and fitting portions, which extend from opposite ends of the coiled portion, wherein the length of a linear material, which constitutes the coiled portion and the fitting portions, falls within the range of 35 mm to 50 mm, a coil outer diameter of the coiled portion falls within the range of 3.0 mm to 3.5 mm, the number of turns in the coiled portion falls within the range of 4.0 to 4.5, and a coil pitch in the coiled portion falls within the range of 0.9 mm to 1.1 mm, whereby re-lighting is enabled in a low fuel gas flow rate region in the vicinity of a fuel gas flow rate of 20 cc/minute.

With the catalyst member for a lighter in accordance with the present invention, the finely divided catalyst carrier is fusion bonded by the fusion bonding material to the surface of the linear base material, and the catalyst, such as platinum, is deposited on the surface of the finely divided catalyst carrier. In cases where the catalyst member for a lighter in accordance with the present invention is located in the vicinity of a combustion fire outlet of a lighter, the same catalytic effects as those of a platinum wire can be obtained with the catalyst deposited on the surface of the finely divided catalyst carrier and, even if the flame is blown off by wind and goes out, the fuel gas can be automatically lighted again by the catalyst deposited on the surface of the finely divided catalyst carrier. Also, the catalyst member for a lighter in accordance with the present invention, which takes on the form of a linear member as a whole, can be formed into a coiled shape or other shapes. Therefore, a good state of contact of the fuel gas with the catalyst member can be obtained in accordance with the gas flow rate, or the like, in the lighter, and combustion with a flame can thereby be obtained. Accordingly, the catalyst member in accordance with the present invention is suitable for use in a lighter. Also, the heat capacity of the catalyst member in accordance with the present invention can be kept small and, as a result, the drop in the temperature of the catalyst after the fire has been extinguished does not become very slow. Therefore, there is no risk that the fuel gas, which has leaked from the fuel gas tank of the lighter, is lighted by the catalyst member after the fire has been extinguished. Further, the amount of the catalyst, such as platinum, used can be kept small, and therefore the cost of the lighter provided with the catalyst member can be kept low.

Specifically, in order for a catalyst member having the same effects as those of a platinum wire to be obtained, it is desirable that the amount of the catalyst supported on the surface of the catalyst member coming into contact with a gas flame flow is sufficient to provide the same level of re-lighting performance as the re-lighting performance of the platinum wire, and that the heat capacity and the heat transfer characteristics of the catalyst member can be set appropriately. In such cases, the temperature of the catalyst can drop quickly after the fire is extinguished. Also, the heat capacity of the catalyst member can be set appropriately such that, even if the combustion flame is blown off by wind and goes out, the fuel gas can be lighted again by the catalyst member during a predetermined period after the combustion flame has gone out. The catalyst member in accordance with the present invention satisfies these requirements, and therefore is suitable as a linear catalyst member for re-lighting a fuel gas in a lighter.

The amount of the catalyst deposited on the finely divided catalyst carrier and the heat capacity of the catalyst member as a whole should be designed to be appropriate values for the lighter, in which the catalyst member is used. The catalyst member for a lighter in accordance with the present invention has the characteristics such that the amount of the catalyst deposited on the finely divided catalyst carrier and the heat capacity of the catalyst member as a whole can be set easily to be the values required for ordinary gas lighters for smoker's requisites and other lighters.

In cases where the finely divided catalyst carrier is constituted of mixed fine particles of fine alumina particles and titanium oxide, the adhesion strength of the fine alumina particles with respect to the linear base material, the strength of the finely divided catalyst carrier constituted of the fine alumina particles, and the support strength of the finely divided catalyst carrier for deposited catalyst particles, such as platinum particles, can be enhanced by the presence of the titanium oxide. As a result, the finely divided catalyst carrier and the catalyst particles can be prevented from peeling due to drop impacts, and the durability with respect to thermal shocks in repeated rapid heating and quenching, or the like, can be enhanced. In particular, better effects can be obtained in cases where the proportion of the titanium oxide falls within the range of 10% by weight to 45% by weight with respect to the fine alumina particles. The proportion of the titanium oxide should more preferably fall within the range of 15% by weight to 45% by weight with respect to the fine alumina particles, and should most preferably fall within the range of 20% by weight to 45% by weight with respect to the fine alumina particles.

With the process for producing a catalyst member for a lighter in accordance with the present invention, the linear catalyst member for a lighter can be produced easily.

With the catalyst member for a lighter in accordance with the present invention, which comprises the coiled portion and has the specific dimensions and the specific shape defined above, it becomes possible to obtain a lighter having stable re-lighting performance. Also, even if the temperature of the lighter becomes low, the liquefied gas in the fuel gas tank of the lighter is cooled, the fuel gas pressure becomes low, and the fuel gas flow rate in the lighter becomes low, a decrease in the performance of the lighter can be prevented as much as possible by appropriately setting the dimensions and the shape of the catalyst member.

DESCRIPTION OF THE PREFERRED EMBODIMENTS

The present invention will hereinbelow be described in further detail with reference to the accompanying drawings.

Figure 1:
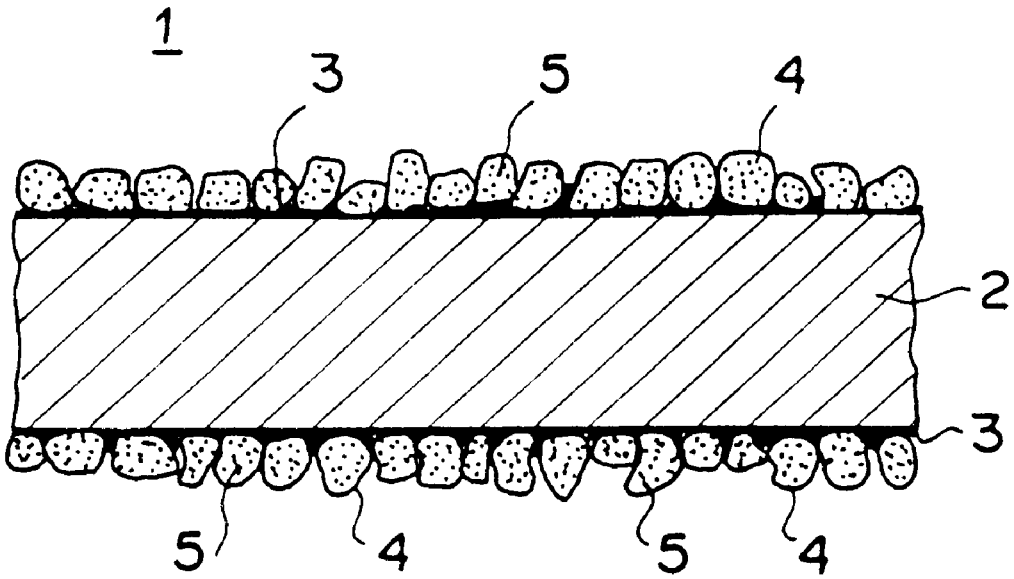
FIG. 1 is an enlarged sectional view showing a fundamental structure of an embodiment of the catalyst member for a lighter in accordance with the present invention.

FIG. 1 is an enlarged sectional view showing a fundamental structure of an embodiment of the catalyst member for a lighter in accordance with the present invention. A catalyst member 1 comprises a linear base material 2, which is constituted of a heat-resistant material, such as a nickel-chrome alloy wire (hereinbelow often referred to as a nichrome wire), and a finely divided catalyst carrier 4, which is fusion bonded and secured to the outer surface of the linear base material 2 by a fusion bonding material 3. The fusion bonding material 3 is constituted of a vitreous fused material or a powdered metal. The finely divided catalyst carrier 4 is constituted of a metal oxide, such as fine alumina particles. A catalyst 5, which may be constituted of platinum particles, or the like, is deposited on the surface of the finely divided catalyst carrier 4. In this manner, the catalyst member 1 takes on the form of a catalyst wire.

The catalyst member 1 can be produced by the steps of (i) fusion bonding the finely divided catalyst carrier 4, which is constituted of a metal oxide, to the surface of the linear base material 2 by the fusion bonding material 3, which is constituted of the powdered metal or the vitreous fused material, (ii) applying a catalyst solution, such as an aqueous solution of a platinum compound, to the surface of the finely divided catalyst carrier 4, and (iii) thermally decomposing the catalyst solution, which has been applied to the surface of the finely divided catalyst carrier 4. In this manner, the catalyst 5, such as platinum particles, is deposited on the surface of the finely divided catalyst carrier 4.

As the material of the finely divided catalyst carrier 4, it is possible to employ fine particles of a metal oxide, such as alumina, zirconium oxide, titanium oxide, or silica; or fine particles of a mixture of these metal oxide, for example, mixed fine particles of alumina and titanium oxide, or mixed fine particles of alumina and zirconium oxide.

As the catalyst 5 of the catalyst member 1, palladium which is cheap, rhodium having a high catalytic efficiency, or the like, may be employed in lieu of platinum. In such cases, as the catalyst solution, for example, a basic aqueous solution of palladium, rhodium, or the like, is used. A plurality of catalysts may be used in combination.

In cases where the nickel-chrome alloy wire is employed as the linear base material 2, mixed powder of nickel and chrome may be fusion bonded to the surface of the linear base material 2, the surface of the mixed powder of the metallic nickel and the metallic chrome, which has been fusion bonded to the surface of the linear base material 2, may serve as the finely divided catalyst carrier 4, and the catalyst 5 may be deposited on the surface of the mixed powder of the metallic nickel and the metallic chrome. In such cases, when the finely divided catalyst carrier 4 is heated at a high temperature in air, its surface is oxidized, and an oxide film layer is thereby formed on the surface. In the actual use state, the operation for lighting a fuel gas is repeated. In cases where metallic silicon, a rare earth metal, or the like, is added to the mixed powder of nickel and chrome, good effects may be obtained in forming the oxide film layers on the surface of the linear base material 2 and the surface of the finely divided catalyst carrier 4 with good adhesion to the primary metal layers. Also, the durability with respect to repeated quick heating and quenching may be enhanced by altering the ratio of nickel and chrome in the mixed powder.

Alternatively, fine particles, which are selected from the group consisting of nickel oxide powder, chromium oxide powder, and mixed powder of nickel oxide and chromium oxide, may be fusion bonded to the surface of the linear base material 2, which is constituted of a nickel-chrome alloy wire, by the fusion bonding material 3, which is constituted of a mixed powder of nickel and chrome. The fusion bonded fine particles, which are selected from the group consisting of nickel oxide powder, chromium oxide powder, and mixed powder of nickel oxide and chromium oxide, may constitute the finely divided catalyst carrier 4. In such cases, the durability with respect to repeated quick heating and quenching may be enhanced by adding metallic silicon or a rare earth metal to the fusion bonding material 3, which is constituted of a mixed powder of nickel and chrome.

EXAMPLE 1

Figure 2:
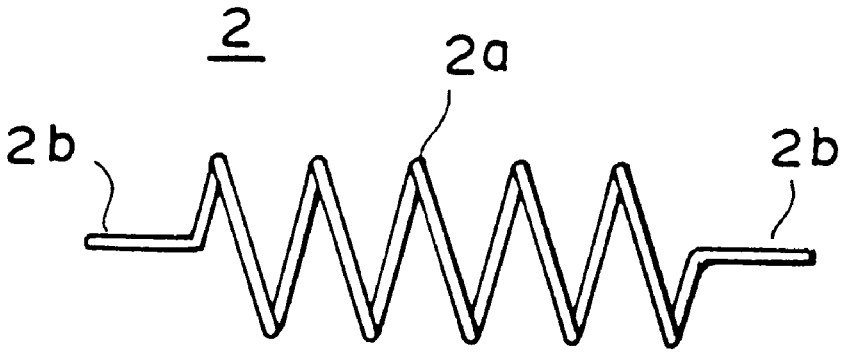
FIG. 2 is a front view showing a linear base material in an embodiment of the catalyst member for a lighter in accordance with the present invention.

In Example 1, in the catalyst member 1, a linear base material 2 having a coiled shape as illustrated in FIG. 2 was employed. As the linear base material 2, a nichrome wire (the ratio nickel:chrome is 80:20) was used. The nichrome wire having a diameter of 0.15 mm and having a length of approximately 31 mm was coiled five turns at equal intervals (for example, at a pitch of 1.25 mm), and a coiled portion 2*a* having an inner diameter of approximately 2 mm was thereby formed. Linear fitting portions 2*b*, 2*b* having a length of 1 mm to 2 mm extended from the opposite ends of the coiled portion 2*a*. The length of the coiled portion 2*a* was 6 mm to 7 mm.

In Example 1, as the fusion bonding material 3, powdered metal comprising a mixture of nickel powder (having a particle diameter of not larger than 10 $\mu$m) and chrome powder (having a particle diameter of 5 $\mu$m to 10 $\mu$m) in a ratio of 80:20 was used. The fusion bonding material 3 constituted of the powdered metal was coated and adhered to the surface of the coiled portion 2*a* of the linear base material 2. The amount of the fusion bonding material 3 was 0.3 mg to 0.5 mg as a whole. Also, as the finely divided catalyst carrier 4, fine alumina particles (having a particle diameter of 0.3 $\mu$m) having a high purity of 99.9% were uniformly coated and adhered onto the fusion bonding material 3. The amount of the finely divided catalyst carrier 4 used was 3 mg as a whole.

Thereafter, the linear base material 2, to which the finely divided catalyst carrier 4 had been adhered, was placed in a high-temperature furnace and heated for 10 minutes at a temperature of 1,200° C. In this manner, the finely divided catalyst carrier 4 constituted of the fine alumina particles was fusion bonded to the surface of the linear base material 2, which was constituted of the nichrome wire, by the fusion bonding material 3 constituted of the mixed powdered metal of nickel and chrome.

After the heating and fusion bonding step was carried out, approximately 0.002 cc, as a whole, of a 0.1% aqueous chloroplatinic acid solution was coated as a catalyst solution to the coiled portion 2*a*. The coiled portion 2*a* was then heated at a temperature of 600° C., and chloroplatinic acid was thereby decomposed thermally. In this manner, platinum particles serving as the catalyst 5 were deposited on the surfaces of the fine alumina particles serving as the finely divided catalyst carrier 4. The catalyst member 1 taking on the form of the coiled wire was thereby obtained.

The catalyst member 1 obtained in the manner described above was located in the vicinity of the top end and the inside of a combustion cylinder 18 of a gas lighter 10 illustrated in FIG. 3, which will be described later, such that the catalyst member 1 may be positioned in a flame produced in the combustion cylinder 18.

In the step for supporting the powdered metal, which served as the fusion bonding material 3, on the surface of the coiled portion 2*a* of the nichrome wire serving as the linear base material 2, a sizing agent was spray coated onto the surface of the coiled portion 2*a*, or a dilute solution of the sizing agent was coated onto the surface of the coiled portion 2*a*. A solvent contained in the sizing agent or in the solution of the sizing agent was then vaporized, and the surface of the linear base material 2 was thereby rendered tacky. Thereafter, the fusion bonding material 3 constituted of the mixed powder of nickel and chrome was spread and adhered to the surface of the linear base material 2. The fusion bonding material 3 was then secured to the surface of the linear base material 2 with a drying operation. The nichrome wire, to which the mixed powder of nickel and chrome had been sized, was then heated at a high temperature of 1,200° C. In this manner, the sizing agent was removed by thermal decomposition, and the mixed powder of nickel and chrome, which served as the fusion bonding material 3, was fusion bonded to the necessary portion of the linear base material 2.

Also, in the step for supporting the fine alumina particles, which served as the finely divided catalyst carrier 4, on the fusion bonding material 3, a sizing agent solution was sprayed or coated onto the necessary portion of the fusion bonded portion of the fusion bonding material 3, and tackiness was thereby imparted to the fusion bonding material 3. Thereafter, a predetermined amount of the fine alumina particles serving as the finely divided catalyst carrier 4 were spread and adhered to the applied layer of the sizing agent solution. The fine alumina particles were then secured to the surface of the fusion bonding material 3 with a drying operation. The nichrome wire, to which the fine alumina particles had been sized, was then heated at a high temperature of 1,200° C. In this manner, the sizing agent was removed by thermal decomposition, and the fine alumina particles were fusion bonded to the linear base material 2 by the fusion bonding material 3 constituted of the nickel-chrome alloy.

EXAMPLE 2

In Example 2, as in Example 1, a linear base material 2 having a coiled shape as illustrated in FIG. 2 was employed.

A low-fused powder glass (i.e., a frit) was mixed with fine alumina particles in a proportion of 1 g per 40 g of the fine alumina particles, i.e. in a proportion of 2.4% with respect to the fine alumina particles. A 5% aqueous solution of polyvinyl alcohol serving as a binder was added to the resulting mixed powder. The weight ratio of the 5% aqueous solution of polyvinyl alcohol to the resulting mixed powder was 40:60. The mixture obtained in this manner was worked into a viscous liquid and coated onto the surface of the coiled portion 2*a* of the linear base material 2.

The alumina mixture having been coated onto the surface of the coiled portion 2*a* of the linear base material 2 was dried at 120° C., and moisture was thereby removed. Thereafter, the alumina mixture was heated at 1,240° C. for approximately 10 minutes. In this manner, the fine alumina particles serving as the finely divided catalyst carrier 4 were fusion bonded to the surface of the nichrome wire, which constituted the linear base material 2, by the low-fused powder glass serving as the fusion bonding material 3.

Thereafter, as in Example 1, an aqueous chloroplatinic acid solution was coated as a catalyst solution to the coiled portion 2*a*. The applied aqueous chloroplatinic acid solution was then dried, and chloroplatinic acid was decomposed thermally. In this manner, platinum particles serving as the catalyst 5 were deposited on the surface of the finely divided catalyst carrier 4, and the catalyst member 1 was thereby obtained.

EXAMPLE 3

In Example 3, as in Example 1, a linear base material 2 having a coiled shape as illustrated in FIG. 2 was employed.

A mixed powdered metal of nickel and chrome (nickel:chrome was 80:20) was mixed with fine alumina particles in a proportion of 1 g per 40 g of the fine alumina particles, i.e. in a proportion of 2.4% with respect to the fine alumina particles. A 5% aqueous solution of polyvinyl alcohol serving as a binder was added to the resulting mixed powder. The weight ratio of the 5% aqueous solution of polyvinyl alcohol to the resulting mixed powder was 40:60. The mixture obtained in this manner was worked into a viscous liquid and coated onto the surface of the coiled portion 2*a* of the linear base material 2.

The alumina mixture having been coated onto the surface of the coiled portion 2*a* of the linear base material 2 was dried at 120° C., and moisture was thereby removed. Thereafter, the alumina mixture was heated at 1,200° C. for approximately 10 minutes. In this manner, the fine alumina particles serving as the finely divided catalyst carrier 4 were fusion bonded to the surface of the nichrome wire, which constituted the linear base material 2, by the low-fused powder glass serving as the fusion bonding material 3.

Thereafter, as in Example 1, an aqueous chloroplatinic acid solution was coated as a catalyst solution to the coiled portion 2*a*. The applied aqueous chloroplatinic acid solution was then dried, and chloroplatinic acid was decomposed thermally. In this manner, platinum particles serving as the catalyst 5 were deposited on the surface of the finely divided catalyst carrier 4, and the catalyst member 1 was thereby obtained.

EXAMPLE 4

In Example 4, as in Example 1, a linear base material 2 having a coiled shape as illustrated in FIG. 2 was employed.

As the finely divided catalyst carrier 4, fine alumina particles (having a particle diameter of 0.3 $\mu$m) and titanium oxide (having a particle diameter of 0.6 $\mu$m to 0.8 $\mu$m) were mixed together in a weight ratio of fine alumina particles-:titanium oxide of 80:20. Thereafter, a low-fused powder glass serving as the fusion bonding material 3 was added in a proportion of 2.4% to the finely divided catalyst carrier 4 and mixed with it. A 5% aqueous solution of polyvinyl alcohol serving as a binder was added to the resulting mixed powder. The weight ratio of the 5% aqueous solution of polyvinyl alcohol to the resulting mixed powder was 40:60. The mixture obtained in this manner was worked into a viscous liquid, and 0.3 mg to 0.5 mg of the viscous liquid was coated onto the surface of the coiled portion 2*a* of the linear base material 2.

The alumina-titanium oxide mixture having been coated onto the surface of the coiled portion 2*a* of the linear base material 2 was dried at 120° C., and moisture was thereby removed. Thereafter, the alumina mixture was heated and sintered at 1,240° C. for approximately 10 minutes, and the catalyst carrier was thereby formed. The catalyst carrier was then dip coated with approximately 0.002 cc, as a whole, of a 0.1% aqueous chloroplatinic acid solution serving as a catalyst solution. The coiled portion 2*a* was then heated at a temperature of 600° C., and chloroplatinic acid was thereby decomposed thermally. In this manner, platinum particles serving as the catalyst 5 were deposited on the surface of the catalyst carrier. The catalyst member 1 taking on the form of the coiled wire was thereby obtained.

In this example, the finely divided catalyst carrier 4 of the catalyst member 1 is formed by mixing titanium oxide into the fine alumina particles. Therefore, the strength of the finely divided catalyst carrier 4 becomes higher than the strength of the finely divided catalyst carrier 4, which is constituted of only the fine alumina particles. Also, the carrying force for the deposited platinum particles becomes large. Accordingly, even if the catalyst member 1 is subjected to drop impacts and thermal shocks due to rapid heating and quenching, the finely divided catalyst carrier 4 can be prevented from cracking and breaking, and the platinum particles can be prevented from coming off the finely divided catalyst carrier 4. As a result, the amount of platinum can be kept reliably, and the catalytic performance can be kept for a long period of time.

However, as will be described later in Experimental Example 3, if the proportion of titanium oxide is lower than 10% by weight with respect to the fine alumina particles, the effects of enhancing the strength cannot be kept large. Also, if the proportion of titanium oxide is not lower than 50% by weight with respect to the fine alumina particles, the amount of titanium oxide becomes excessively large, and the amount of the fine alumina particles serving as the catalyst carrier for directly supporting the catalyst becomes small. Therefore, the initial amount of the catalyst carried on the finely divided catalyst carrier 4 becomes small, and a sufficient catalytic performance cannot be obtained. The proportion of titanium oxide with respect to the fine alumina particles should preferably fall within the range of 10% by weight to 45% by weight, should more preferably fall within the range of 15% by weight to 45% by weight, and should most preferably fall within the range of 20% by weight to 45% by weight.

APPLICATION EXAMPLE

Figure 3:
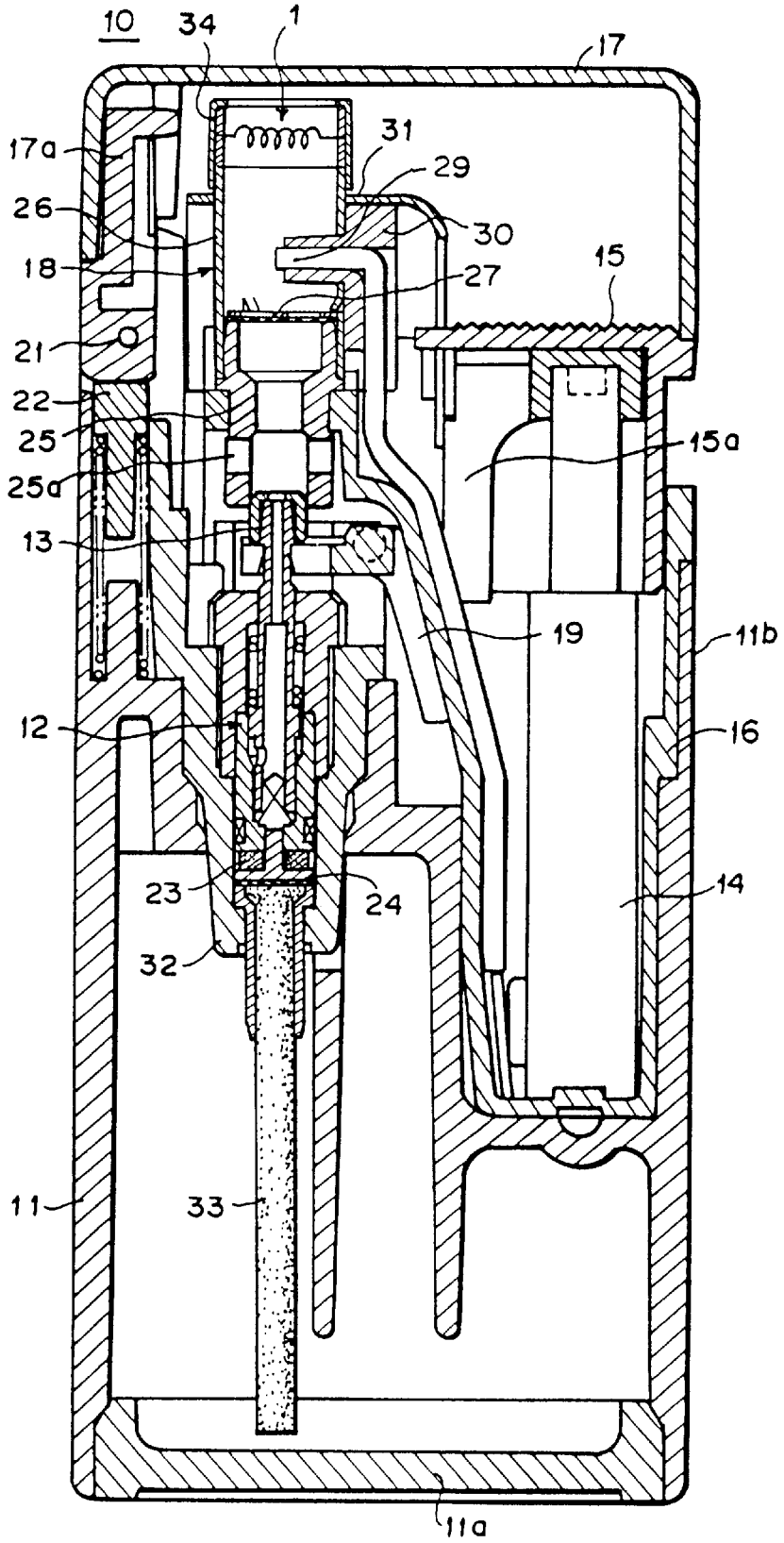
FIG. 3 is a vertical sectional view showing a gas lighter serving as a lighter, which is provided with the embodiment of the combustion device in accordance with the present invention.
Figure 4:
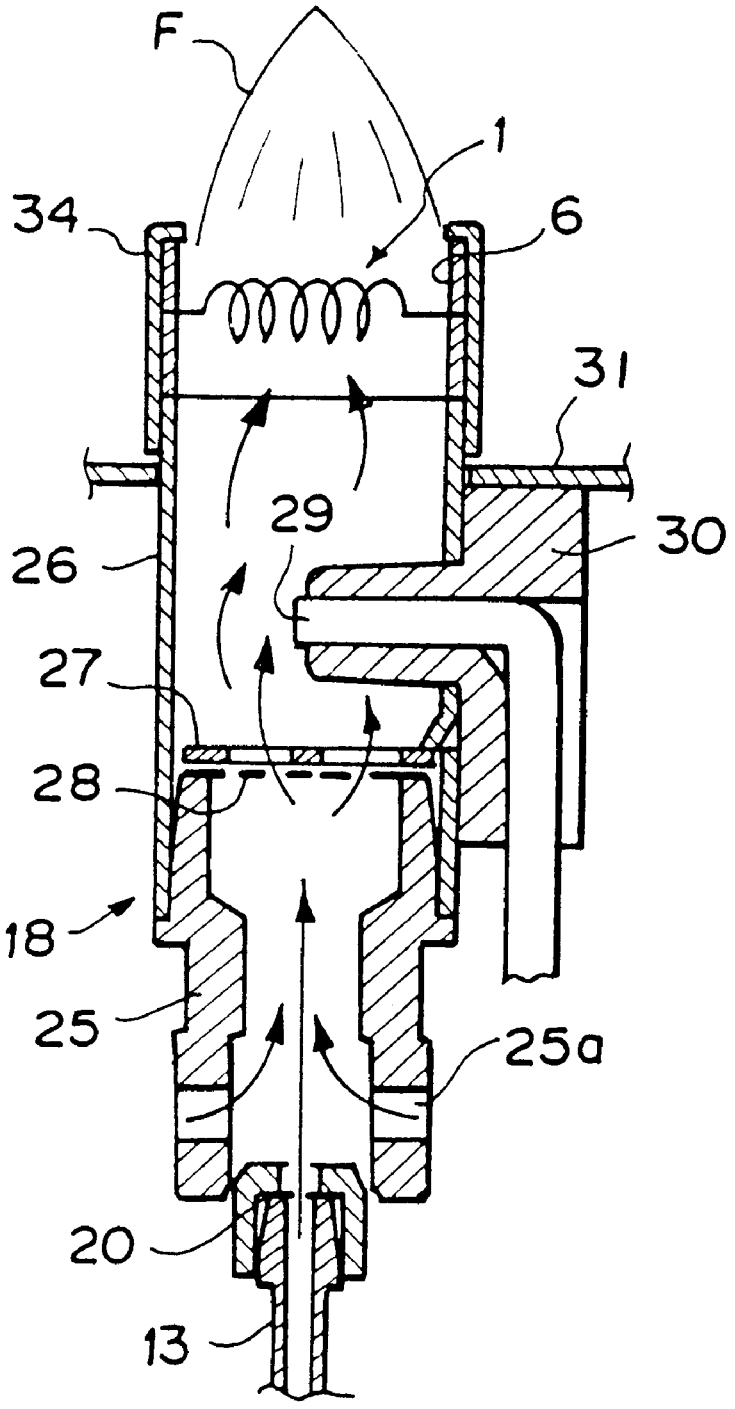
FIG. 4 is an enlarged sectional view showing a major part of the gas lighter shown in FIG. 3, FIGS. 5 and 6 are graphs showing results of Experimental Example 1.

FIG. 3 is a vertical sectional view showing a gas lighter serving as a lighter, which is provided with the coiled catalyst member 1 of Example 1, 2, 3, or 4. FIG. 4 is an enlarged sectional view showing a combustion cylinder of the gas lighter shown in FIG. 3.

A gas lighter 10 (serving as a lighter) is provided with a tank body 11, which stores a fuel gas and is located at the lower part of the gas lighter 10. The tank body 11 is made by molding a synthetic resin. A bottom cover 11*a* is fitted to the bottom portion of the tank body 11, and a high-pressure fuel gas, such as isobutane gas, is stored in the tank body 11. A side wall 11*b* is integrally molded at the upper peripheral surface of the tank body 11. A valve mechanism 12, which is provided with a nozzle 13 for jetting the fuel gas, is accommodated in a valve housing 32. The valve housing 32, in which the valve mechanism 12 is accommodated, is fitted into an upper end of the tank body 11. A combustion cylinder 18, in which the fuel gas having been jetted from the nozzle 13 is burned, is located above the nozzle 13. The combustion cylinder 18 is of the internal combustion type, and the fuel gas, into which primary air has been mixed, is burned therein.

A piezo-electric unit 14 is located along a side of the valve mechanism 12. An operation member 15 is located at an upper end of the piezo-electric unit 14. The operation member 15 operates the valve mechanism 12 in order to jet the fuel gas from the nozzle 13 and operates the piezo-electric unit 14 in order to light the fuel gas having been jetted from the nozzle 13. The piezo-electric unit 14, the operation member 15, and the combustion cylinder 18 are supported by an inner housing 16 and coupled with the tank body 11.

A rising-falling type of cover 17 opens and closes the upper part of the combustion cylinder 18 and the area above the operation member 15. A fulcrum member 17*a* is secured to the cover 17 and pivotably supported on the tank body 11 by a pin 21. A push-up member 22 is urged upwardly such that it may come into contact with either one of two surfaces of the fulcrum member 17*a* in order to hold the cover 17 at the open position or the closed position.

In the valve mechanism 12, a fuel gas flow path is opened by an upward movement of the nozzle 13, and the fuel gas is jetted from a top end of the nozzle 13. An L-shaped actuating lever 19 is located such that its one end may be engaged with the nozzle 13. The actuating lever 19 is pivotably supported by a fulcrum located at an intermediate portion of the actuating lever 19. An operating portion at the other end of the actuating lever 19 comes into contact with a lever push piece 15*a* of the operation member 15 and is thereby rotated. In this manner, the actuating lever 19 actuates and ceases the jetting of the fuel gas from the nozzle 13. A nozzle plate 20, which is shown in FIG. 4 and has a hole having a predetermined diameter (for example, 50 $\mu$m), is located at the top end of the nozzle 13. The nozzle plate 20 is fitted into the bottom of the combustion cylinder 18, and the fuel gas is quickly jetted into the combustion cylinder 18.

Also, the valve mechanism 12 is provided with a gas flow rate adjusting filter 23, which adjusts such that the amount of the fuel gas jetted may be kept approximately at a predetermined value even if the temperature changes. The gas flow rate adjusting filter 23 is located in a compressed state at the bottom of the valve mechanism 12 by a nail-like stator 24. The liquefied fuel gas moves through a porous core 33 from the tank. The liquefied fuel gas, which has moved through the porous core 33, flows radially from the outer periphery of the gas flow rate adjusting filter 23 towards the center of the gas flow rate adjusting filter 23 and is thus vaporized. The gas flow rate adjusting filter 23 is constituted of a micro-cell polymer foam comprising open cells, which communicate with one another through micro-pores at points of contact and thus constitute a gas flow path, and closed cells, which expand or contract with a change in temperature and thereby compress or enlarge the gas flow path. The gas flow rate adjusting filter 23 has the effects of automatically adjusting the gas flow rate with respect to a change in temperature.

As illustrated also in FIG. 4, the combustion cylinder 18 comprises a base member 25, which is located at the base portion of the combustion cylinder 18, and a combustion pipe 26, which is secured to the base member 25 and extends upwardly. The base member 25 has a gas flow path, which extends through the center portion of the base member 25. The bottom end of the base member 25 is fitted onto the top end of the nozzle 13. A radially-extending primary air hole 25*a* opens on opposite sides of the base member 25 and at a position above the bottom end of the base member 25.

An eddy flow plate 27 and a metal mesh member 28 are placed on the top end of the base member 25. The eddy flow plate 27 is constituted of a metal disk having apertures. The eddy flow plate 27 produces a turbulent flow in of the fuel gas flow and thereby enhances the mixing of the fuel gas and the primary air. The metal mesh member 28 is constituted of circular wire gauze and prevents a back flow of the flame.

The operation member 15 is supported by being associated with the piezo-electric unit 14 such that the operation member 15 can slide downwardly. An electrical discharge electrode 29, which is connected to the piezo-electric unit 14, is located along a side of the operation member 15. The electrical discharge electrode 29 is held by an electrode holder 30, which extends through the side wall of the combustion pipe 26, such that an end of the electrical discharge electrode 29 may stand facing the area inside of the combustion pipe 26.

An outer peripheral portion of the base member 25 of the combustion cylinder 18, which portion is located above the primary air hole 25*a*, is engaged with and supported by the inner housing 16. The base member 25 is thus supported together with the combustion pipe 26. The combustion cylinder 18 is associated with the electrical discharge electrode 29 and the electrode holder 30, and a cover 31 is located on the outward side of the electrode holder 30. The combustion cylinder 18 is secured in this manner. These members are assembled together with the piezo-electric unit 14 and the operation member 15 by the inner housing 16. The assembly is assembled to the tank body 11. Therefore, the assembling work can be kept simple.

The coiled catalyst member 1 is located in the vicinity of the top end of the combustion pipe 26 of the combustion cylinder 18. The fitting portions 2*b*, 2*b* extending from the opposite ends of the coiled portion 2*a* of the catalyst member 1 are secured to an annular member 6, which has the same shape as the shape of the combustion pipe 26, and the catalyst member 1 is located radially in the annular member 6. The annular member 6 is located at the top end of the combustion pipe 26, and a cap 34 is fitted onto the outer periphery of the annular member 6 and the outer periphery of the combustion pipe 26. In this manner, the catalyst member 1 is located at the opening of the fire outlet at the top end of the combustion pipe 26.

In the gas lighter 10 constructed in the manner described above, when the cover 17 is opened and the operation member 15 is pushed down, the lever push piece 15*a* of the operation member 15 causes the actuating lever 19 to rotate. The nozzle 13 is thus moved up by the actuating lever 19. As a result, the fuel gas is jetted from the nozzle 13. The primary air is introduced from the primary air hole 25*a*, which opens through the side wall of the base member 25 of the combustion cylinder 18, by the effects of a negative pressure, which is produced by the flow velocity and the flow rate of the fuel gas being jetted from the nozzle 13. The primary air having been introduced from the primary air hole 5 is mixed with the jetted fuel gas. The primary air and the fuel gas pass through the metal mesh member 28 for preventing a back flow of the flame and thereafter stirred and mixed together by the eddy flow plate 27. The resulting mixed gas flows upwardly in the combustion pipe 26.

When the operation member 15 is pushed down even further, the piezo-electric unit 14 is actuated by the operation member 15. In this manner, a high voltage for electrical discharge is applied to the electrical discharge electrode 29, discharge is caused to occur, and the mixed gas is lighted. As a result, the mixed gas burns such that a portion of a flame F is produced on the side inward from the top end of the combustion cylinder 18. The position, at which a high-temperature portion of the flame F occurring from the combustion is located, is determined by the mixing ratio of the primary air and the fuel gas and the flow velocity of the mixed gas. It is favorable that the catalyst member 1 described above is located at the position of the high-temperature portion of the flame.

The combustion flame F produced passes through the catalyst member 1. The catalyst member 1 located at the top end of the combustion cylinder 18 comes into contact with the high-temperature portion of the combustion flame F. In such cases, the catalyst 5 of the catalyst member 1 is quickly heated at a temperature not lower than the temperature, at which a catalytic reaction can occur. As a result, the catalyst 5 comes into a red heat state. In cases where the flame F is blown off by wind and goes out, even if a re-lighting operation by the piezo-electric unit is not carried out, the mixed gas is lighted again by the catalyst member 1, which has been heated to a temperature not lower than the catalytic reaction temperature (approximately 600° C.) for the oxidative combustion of the mixed gas. Therefore, the combustion can be continued. In the ordinary use state, the operation member 15 is continuously pushed down during the lighting, the fuel gas is continuously blown to the catalyst member 1, and therefore the flame F is produced approximately continuously.

When the operation member 15 is released, the fuel gas is ceased from jetting, and the fire is thus extinguished, the temperature of the catalyst member 1, the heat capacity of which is not very large, can drop quickly. Therefore, even if the fuel gas thereafter leaks from the fuel gas tank, it is not lighted by the catalyst member 1.

In cases where, in lieu of platinum, palladium is used as the catalyst 5 of the catalyst member 1, the temperature, at which the re-lighting can be effected, becomes higher than with platinum. However, re-lighting can be effected with palladium in the state in which the fuel gas is being jetted continuously. Also, platinum and palladium different in the temperature, at which the re-lighting can be effected, may be mixed with each other in a predetermined ratio, and the resulting mixture may be supported on the finely divided catalyst carrier 4. With such a catalyst member 1, the temperature, at which the re-lighting can be effected, varies in accordance with the ratio, in which platinum and palladium are mixed with each other.

In the examples described above, the catalyst member 1 is used in the lighter for burning the fuel gas, into which the primary air has been mixed. The catalyst member in accordance with the present invention is also applicable to gas lighters, or the like, in which a fuel gas jetted from an ordinary fuel gas jetting nozzle is lighted and burned only with secondary air.

Also, in the examples described above, the linear base material 2 takes on the form of the coiled shape. However, the catalyst member in accordance with the present invention may have one of various other shapes. For example, a required number of bar-shaped catalyst members may be located, for example, in parallel, or the portion of the catalyst member coming into contact with the flame may be formed into a wave-like shape.

Experimental Example 1

As for the catalyst member 1 having the coiled shape and obtained in Example 1, experiments were carried out to find the relationship among the amount of the finely divided catalyst carrier 4 (fine alumina particles), which was fusion bonded, the number of coatings of the catalyst solution (an aqueous chloroplatinic acid solution having a concentration of 0.1%), and the re-lighting percentage. The results shown in FIG. 5 were obtained. Also, experiments were carried out to find the relationship among the concentration of the catalyst solution (an aqueous chloroplatinic acid solution), the particle diameter of the finely divided catalyst carrier 4 (fine alumina particles), and the re-lighting percentage. The results shown in FIG. 6 were obtained.

Figure 5:
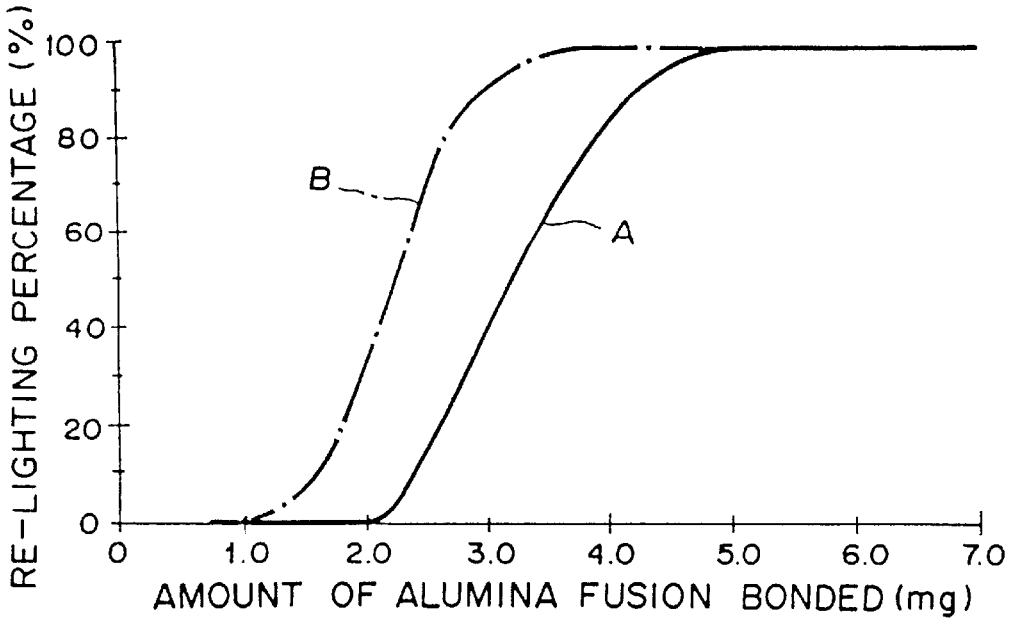

In the experiments, the linear base material 2 shown in FIG. 2 was used. Specifically, a nichrome wire having a diameter of 0.15 mm was coiled five turns at a pitch of 1.25 mm, and a coiled portion having an inner diameter of 2.0 mm was thereby formed. The nichrome wire thus coiled was used as the linear base material 2. In FIG. 5, curve A represents the results obtained by coating the 0.1% aqueous chloroplatinic acid solution one time, and curve B represents the results obtained by coating the 0.1% aqueous chloroplatinic acid solution two times. In each experiment, the amount of alumina having been fusion bonded was altered, and the re-lighting percentage was measured.

In the measurements of the re-lighting percentage, with gas lighters in which the respective catalyst members had been fitted into the combustion cylinders, the operations described below were successively carried out.

1) After the fuel gas was lighted, the combustion was continued for approximately one second, and the catalyst member was thereby heated.

2) Approximately one second after the fire was extinguished, the fuel gas was jetted from the nozzle without a lighting operation by the piezo-electric unit being carried out.

3) After the fuel gas was thus jetted, it was investigated whether the fuel gas is or is not lighted again within three seconds.

4) Approximately one second the fire was again extinguished, the fuel gas was again jetted. These operations were repeated 10 cycles, and the percentage of re-lighting was calculated. The value thus obtained was taken as the re-lighting percentage.

From the results shown in FIG. 5, it was found that, as the amount of alumina having been fusion bonded to the nichrome wire becomes larger, the amount of the catalyst carried on the alumina becomes larger, and the re-lighting percentage becomes higher. Also, it was found that, when the alumina having been fusion bonded is the same and the number of dip-coatings in the catalyst solution is two, the amount of the catalyst carried on the alumina becomes larger, and the re-lighting percentage becomes higher.

Figure 6:
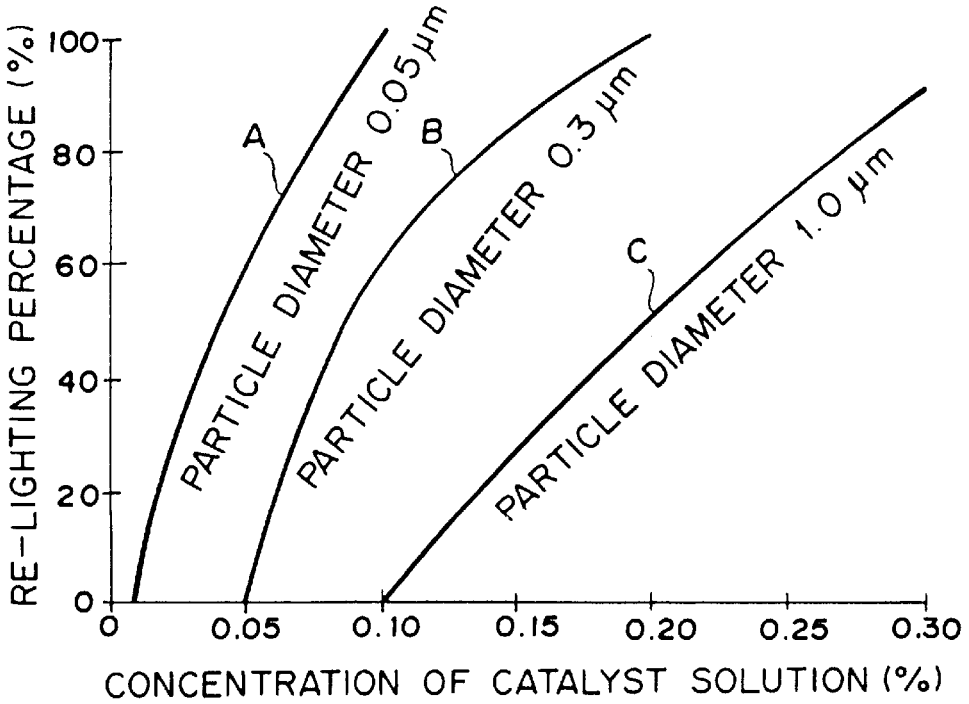

Also, as illustrated in FIG. 6, three kinds of fine alumina particles respectively having particle diameters of 0.05 $\mu$m, 0.3 μm, and 1.0 μm were prepared. A predetermined amount (3 mg) of each of the three kinds of the fine alumina particles was fusion bonded to the surface of the nichrome wire having the coiled shape by the low-fused powder glass. The nichrome wire was then dip coated with one of aqueous chloroplatinic acid solutions having different concentrations. Thereafter, platinum particles were deposited on the surfaces of the fine alumina particles having been fusion bonded, and the re-lighting percentage was measured in the same manner as that described above. In FIG. 6, curve A represents the results obtained with the fine alumina particles having a particle diameter of 0.05 μm, curve B represents the results obtained with the fine alumina particles having a particle diameter of 0.3 μm, and curve C represents the results obtained with the fine alumina particles having a particle diameter of 1.0 μm. From the results shown in FIG. 6, it was found that, when the amount of the fine alumina particles having been fusion bonded to the nichrome wire is kept the same, as the particle diameter of the fine alumina particles having been fusion bonded becomes smaller, the catalyst carrying area and the gas contact area become larger, and therefore a higher re-lighting percentage can be obtained even with the catalyst solutions having lower concentrations.

Experimental Example 2

Experiments were carried out to compare the re-lighting percentage of the catalyst member 1 (catalyst wire) in accordance with the present invention and the re-lighting percentage of a platinum wire. The results shown in Table 1 were obtained. The catalyst member 1 used in the experiments was prepared by fusion bonding a finely divided catalyst carrier, which was constituted of fine alumina particles or fine zirconium oxide, to the surface of a nichrome wire by a fusion bonding material, which was constituted of a Ni—Cr mixed powder or low-fused powder glass, dip coating the finely divided catalyst carrier, which had thus been fusion bonded, with a 0.1% aqueous chloroplatinic acid solution, and depositing platinum particles on the finely divided catalyst carrier. The particle diameter of the finely divided catalyst carrier was 0.3 μm, and the ratio of the finely divided catalyst carrier to the fusion bonding material was 40:1. The amount of the finely divided catalyst carrier having been fusion bonded was altered such that the wire diameter as a whole might be adjusted, and such that the amount of the catalyst supported might be changed in three stages. In this manner, samples of catalyst members 1 (catalyst wires) were prepared.

Figure 7A:
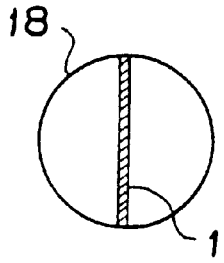
FIGS. 7A through 7F are explanatory views showing examples of arrangements of catalyst wires employed in Experimental Example 1.
Figure 7B:
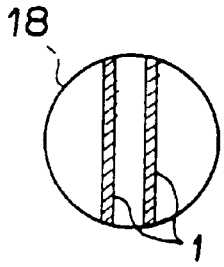
Figure 7C:
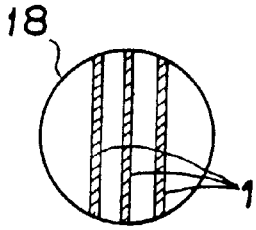
Figure 7D:
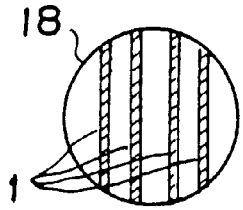
Figure 7E:
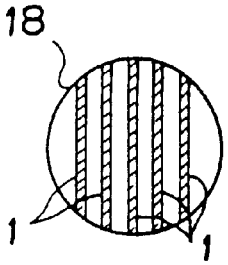
Figure 7F:
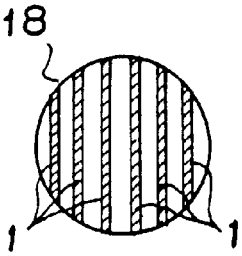

As illustrated in FIG. 7A, a single catalyst member 1 (catalyst wire) was located at the top portion of the combustion cylinder 18. Also, as illustrated in FIGS. 7B through 7F, two to six catalyst wires were located in parallel at the top portion of the combustion cylinder 18. In this state, the re-lighting percentage was measured in the same manner as that in Experimental Example 1. From the experiments, the results shown in Table 1 were obtained. Also, as comparative examples, platinum wires having different diameters were employed as samples, and each sample was located in the combustion cylinder 18 in the same manner as that described above, and the re-lighting percentage was measured. The results thus obtained are also shown in Table 1.

TABLE 1

| No | Entire diameter (mm) | material of carrier | Amount of carrier (mg) | Fusion bonding material | Re-lighting percentage: One wire | Two wires | Three wires | Four wires | Five wires | Six wires |
|---|---|---|---|---|---|---|---|---|---|---|
| 1-1 | 0.2 | Alumina | 0.2~0.3 | NiCr powder | 0 | 0 | 0 | 0 | 0 | 0 |
| 1-2 | 0.3 | " | 0.8~1.1 | " | 0 | 0 | 0 | 0 | 0 | 50 |
| 1-3 | 0.5 | " | 2.5~3.5 | " | 0 | 30 | 100 | 100 | 100 | 100 |
| 2-1 | 0.2 | Alumina | 0.2~0.3 | powder glass | 0 | 0 | 0 | 0 | 0 | 0 |
| 2-2 | 0.3 | " | 0.8~1.1 | " | 0 | 0 | 0 | 10 | 80 | 100 |
| 2-3 | 0.5 | " | 2.5~3.5 | " | 0 | 70 | 100 | 100 | 100 | 100 |
| 3-1 | 0.15 | zirconium oxide | 0.2~0.3 | powder glass | 0 | 0 | 0 | 0 | 0 | 0 |
| 3-2 | 0.25 | " | 0.8~1.1 | " | 0 | 0 | 0 | 0 | 0 | 0 |
| 3-3 | 0.45 | " | 2.5~3.5 | " | 0 | 0 | 0 | 20 | 50 | 50 |
| 4-1 | 0.1 | platinum wire | — | — | 0 | 0 | 0 | 0 | 0 | 0 |
| 4-2 | 0.2 | " | — | — | 0 | 0 | 0 | 0 | 0 | 0 |
| 4-3 | 0.3 | " | — | — | 0 | 0 | 0 | 0 | 0 | 0 |

From the results shown in Table 1, it was found that sample Nos. 2-3 and 1-3 have a high re-lighting percentage. Specifically, a re-lighting percentage of 100% can be obtained when the finely divided catalyst carrier is constituted of the fine alumina particles, the fusion bonding material is constituted of the low-fused powder glass or the Ni—Cr mixed powder, the amount of the finely divided catalyst carrier is increased such that the diameter of the catalyst wire may become equal to approximately 0.5 mm, and three or more of the catalyst wires are located in parallel.

On the other hand, as for the platinum wire, the re-lighting percentage is 0% even with sample No. 4-3 having a wire diameter of 0.3 mm. This is presumably because little catalytic reaction occurs due to a low degree of contact of the platinum wire with the fuel gas, or because the temperature of the platinum wire drops quickly due to a small heat capacity and therefore the re-lighting cannot be effected.

Experimental Example 3

As for the catalyst member 1, which was obtained in Example 4 and in which the finely divided catalyst carrier 4 was constituted of fine alumina particles and titanium oxide, a drop impact test was carried out by altering the proportion of the titanium oxide with respect to the fine alumina particles. From the drop impact test, the results shown in FIGS. 8A and 8B were obtained. Also, a lighting test with repeated rapid heating and quenching was carried out. The results shown in FIGS. 9A and 9B were obtained.

With the drop impact test, it is possible to find the breakage of the catalyst member and the state of falling of the deposited platinum particles due to drop impacts. With the lighting test, it is possible to find deterioration, such as cracking, of the catalyst member and a decrease of the catalytic performance due to coming off of the platinum particles due to thermal shocks during the rapid heating and quenching.

As experimental samples in the tests, the finely divided catalyst carrier was fusion bonded to nichrome wires (having a wire diameter of 0.15 mm), and the resulting straight line-like catalyst members (having a diameter of 1.0 mm and a length of 8.0 mm) were used. The amount of the finely divided catalyst carrier supported on the nichrome wire was 5 mg. The proportion of titanium oxide with respect to the fine alumina particles contained in the finely divided catalyst carrier was changed between 0% by weight and 60% by weight. Also, a low-fused powder glass was mixed in a proportion of 2% with the mixture of the fine alumina particles and titanium oxide. The resulting mixture was coated onto the nichrome wire and baked at 1,240° C. for 10 minutes. Thereafter, the nichrome wire, to which the finely divided catalyst carrier had been fusion bonded, was dip coated with a 0.2% aqueous chloroplatinic acid solution. The applied layer of the aqueous chloroplatinic acid solution was dried and then thermally decomposed at 600° C.

In the drop impact test, each experimental sample was secured to a sample holder having the same shape as the annular member 6 shown in FIG. 4. The sample holder, to which the experimental sample had been secured, was mounted at the top portion of the combustion cylinder 18 of the gas lighter 10 (gas flow rate: 40 cc/minute) having the structure shown in FIG. 3. With the gas lighter 10, the fuel gas was jetted and lighted, and the experimental sample was heated by the combustion flame. The fuel gas was then ceased from being jetted, and the flame was extinguished. Immediately after the flame had been extinguished, the fuel gas was jetted again without the lighting operation by the piezo-electric unit being carried out. In this manner, the fuel gas was lighted again by the catalytic reaction, and the combustion was continued. Also, as a separate operation, an electric current was applied across a reference sample of a nichrome wire (having a wire diameter of 0.15 mm and a coiled shape) with a direct current power source, and the reference sample was thereby caused to come into a red heat state. The value of the electric current flowing through the reference sample was adjusted such that the reference sample might have the same brightness as the brightness of the experimental sample in the combustion state. At this time, the temperature of the reference sample was measured with a thermocouple. The measured temperature was recorded as a catalytic combustion heating temperature.

Thereafter, the sample holder, to which the experimental sample had been secured, was fitted into a cylindrical fixture for drop impact test (having a weight of 27 g). The cylindrical fixture was then dropped from a height of 1.5 m onto a concrete block with the experimental sample side facing down.

After the drop impact had been given to the experimental sample, the experimental sample (the sample holder) was taken out of the fixture and mounted in the gas lighter. The lighting, the fire extinguishment, and the re-lighting were carried out in the same manner as that described above, and the catalytic combustion heating temperature was measured. This cycle was repeated ten times, and the catalytic combustion heating temperature corresponding to the number of drops was measured with respect to each of various proportions of titanium oxide to the fine alumina particles.

Figure 8A:
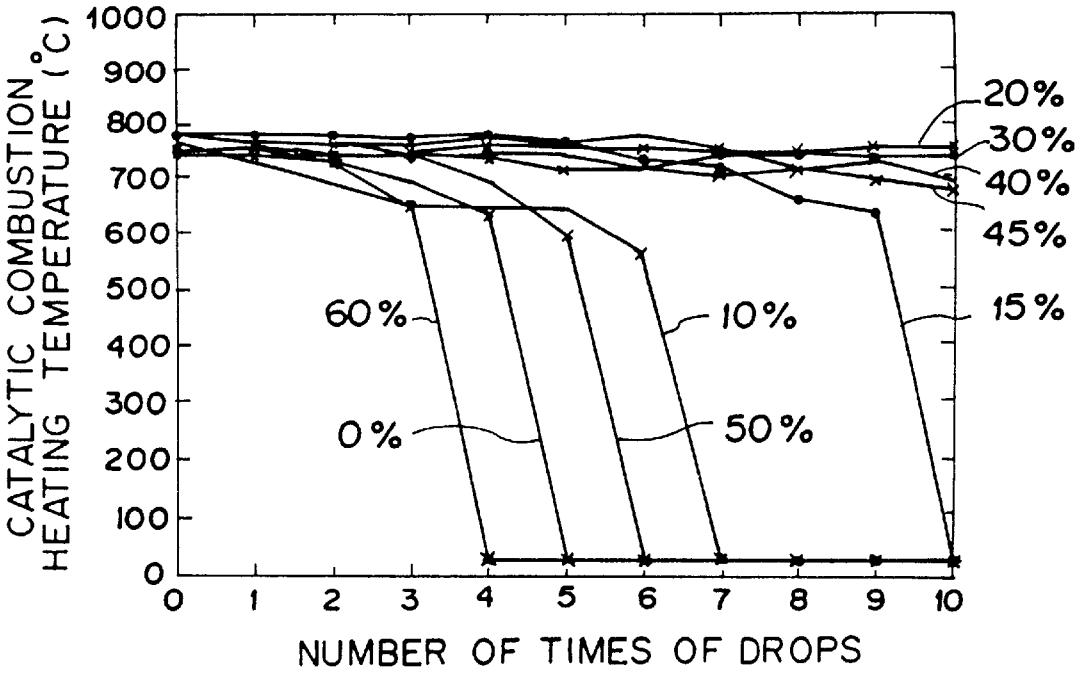
FIGS. 8A and 8B are graphs showing results of a drop impact test in Experimental Example 3.
Figure 8B:
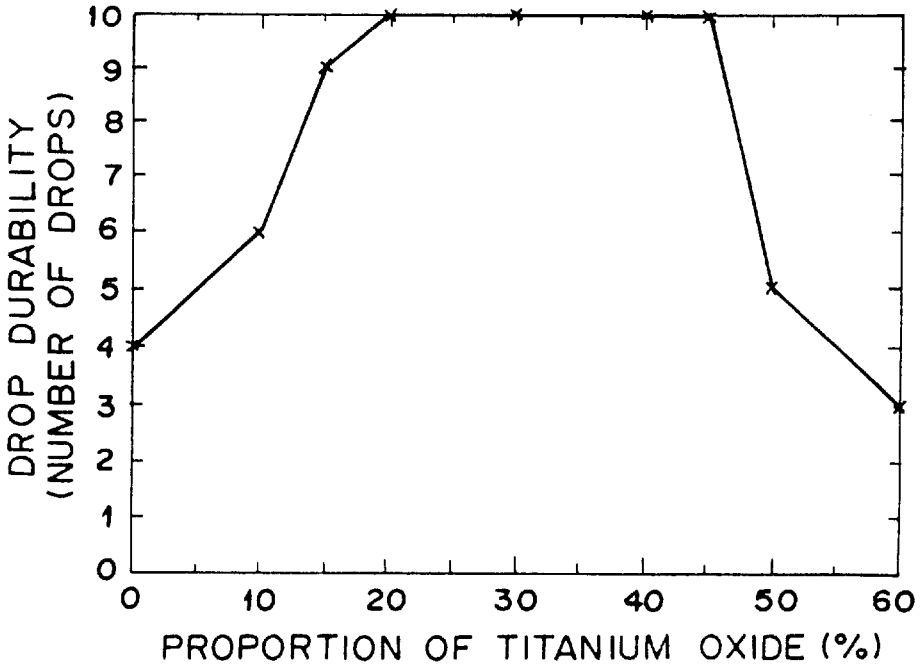

FIG. 8A shows a change in the catalytic combustion heating temperature with respect to the number of drops for each proportion of titanium oxide with respect to the fine alumina particles. FIG. 8B shows a change in the drop durability (number of drops) with respect to the proportion of titanium oxide, which change was calculated from the results of the measurements shown in FIG. 8A. In cases where the proportion of titanium oxide was 70% by weight or more, the amount of the fine alumina particles became very small, the amount of platinum carried on the finely divided catalyst carrier became insufficient, and no catalytic reaction was obtained at the initial stage. Therefore, results for the proportion of titanium oxide was 70% by weight or more are not shown in FIGS. 8A and 8B.

The catalytic combustion heating temperature serves as an index for judging the catalytic performance of the catalyst member. When the fire is extinguished after the fuel gas is lighted, and the fuel gas is then jetted before the temperature of the catalyst member does not decrease and without a lighting operation by the piezo-electric unit being carried out, the fuel gas comes into contact with the hot catalyst and is thereby lighted again. The temperature of the catalyst is raised by the heat of combustion and is equilibrated with the heat of combustion of the fuel gas, and the combustion is continued at a predetermined temperature. The catalytic combustion heating temperature represents the temperature, at which the combustion is thus continued. The catalytic combustion heating temperature varies in accordance with the amount of the platinum particles dispersed and carried on the finely divided catalyst carrier. Specifically, the portion of the gas flow, which comes into contact with platinum, burns, and the catalyst member is heated by the heat of combustion of the gas flow. If the amount of platinum becomes small, the heat of combustion will also decrease, and the temperature of the catalyst member, i.e. the catalytic combustion heating temperature, becomes low. If the catalytic performance of the catalyst member is lost, even if the fuel gas is jetted after the fire has been extinguished, it cannot be lighted again, and the temperature of the catalyst member will not rise.

From the foregoing and the results shown in FIG. 8A, it was found that, in cases where the proportion of platinum with respect to the fine alumina particles is 60% by weight, 0% by weight, 50% by weight, 10% by weight, or 15% by weight, the catalytic combustion heating temperature decreases sharply and the re-lighting becomes impossible before the number of drops reaches 10. This indicates that the coming off of the platinum particles occurred due to the drop impacts. In cases where the proportion of platinum with respect to the fine alumina particles falls within the range of 20% by weight to 45% by weight, a high catalytic combustion heating temperature can be kept, little coming off of platinum occurs, and good catalytic performance can be obtained even after ten times of drops.

According to the Japanese safety standards SG for gas lighters, as for the impact resistance, it is stipulated that no change should occur when a gas lighter is allowed to drop from a height of 1.5 m and three times onto a concrete block, one time in each of facing-up, facing-down, and horizontal orientations of the gas lighter. Therefore, in cases where the number of drops as the drop durability is found to be at least six in the drop impact test described above, a comparatively good quality can be guaranteed.

Accordingly, from the results of the measurements of the drop durability shown in FIG. 8B, it was found that the proportions of titanium oxide falling within the range of 20% by weight to 45% by weight, in which the number of drops as the drop durability is at least ten, are most preferable. The proportions of titanium oxide of 15% by weight and 10% by weight, in which the number of drops as the drop durability is nine and six, are also preferable. Thus good results can be obtained when the proportion of titanium oxide falls within the range of 10% by weight to 45% by weight.

In the lighting test, experimental samples were prepared in the same manner as that in the drop impact test described above. Each experimental sample was secured to a sample holder, and the sample holder, to which the experimental sample had been secured, was fitted into a gas lighter. First, the lighting, the fire extinguishment, and the re-lighting were carried out in the same manner as that described above, and the initial catalytic combustion heating temperature was measured.

Figure 9A:
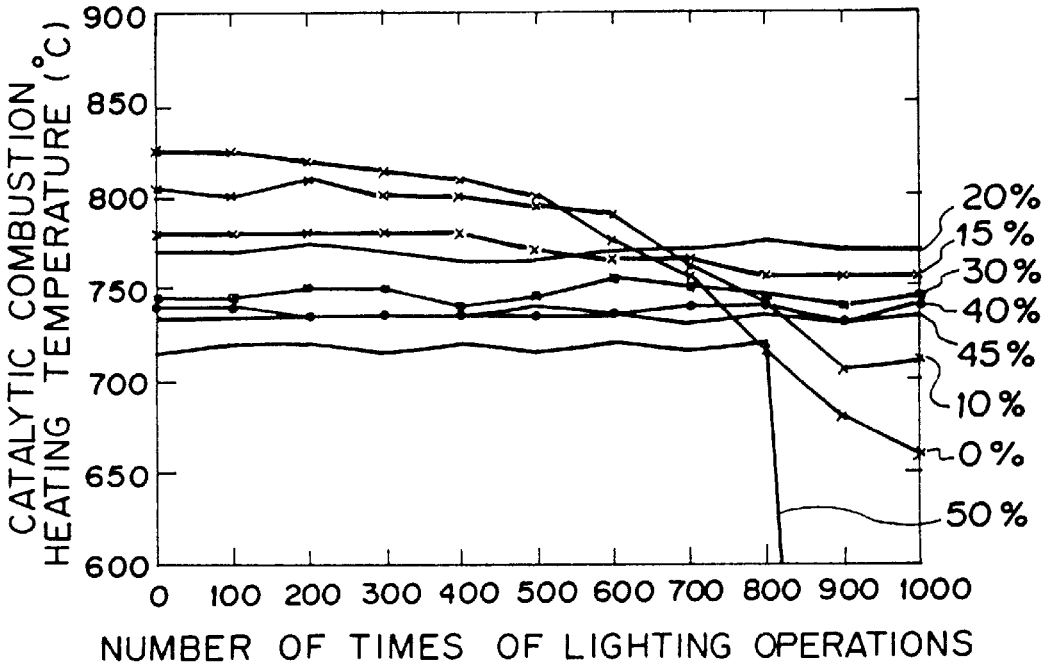
FIGS. 9A and 9B are graphs showing results of a repeated lighting test in Experimental Example 3.
Figure 9B:
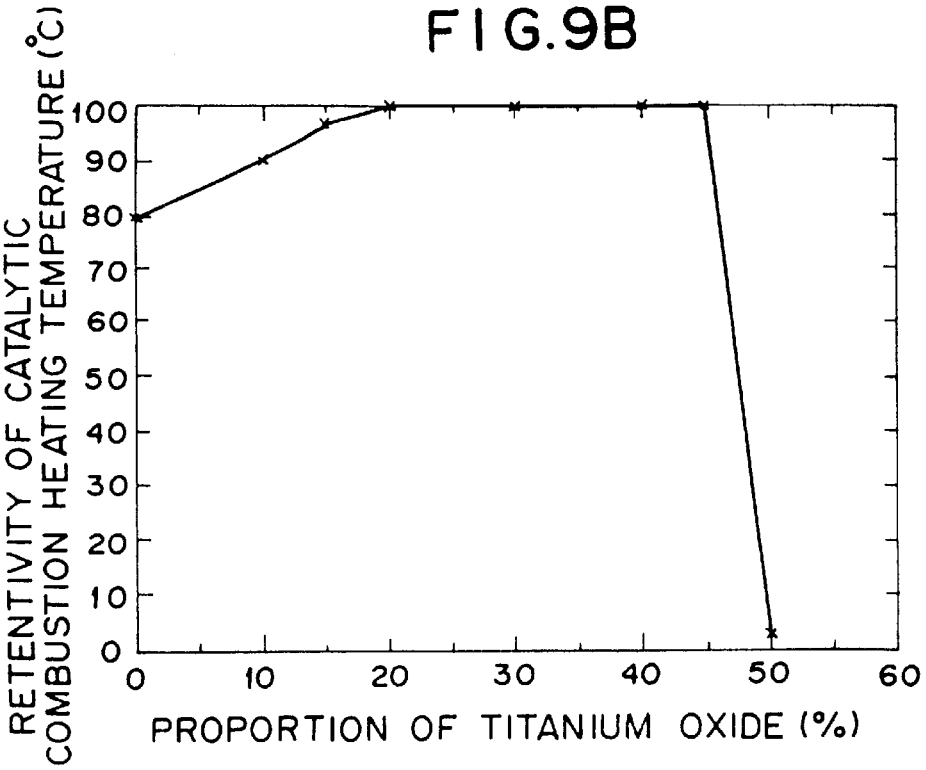

Thereafter, with the gas lighter, in which the experimental sample had been fitted, rapid heating with two-second lighting and quenching with two-second fire 4 extinguishment were repeated 100 times. The lighting, the fire extinguishment, and the re-lighting were then carried out, and the catalytic combustion heating temperature was measured. Thereafter, each time rapid heating and quenching were repeated 100 times, the measurement of the catalytic combustion heating temperature was carried out. The measurements were carried out up to 1,000 times of repetition of rapid heating and quenching, and the lighting test was finished FIG. 9A shows a change in the catalytic combustion heating temperature with respect to the number of lighting for each proportion of titanium oxide with respect to the fine alumina particles. FIG. 9B shows a change in the retentivity of the catalytic combustion heating temperature with respect to the proportion of titanium oxide, which change was calculated from the results of the measurements shown in FIG. 9A. The retentivity of the catalytic combustion heating temperature represents the percentage of the catalytic combustion heating temperature, which is obtained after 1,000 times of lighting, with respect to the initial catalytic combustion heating temperature. A smaller value of the retentivity of the catalytic combustion heating temperature indicates a larger decrease in the catalytic combustion heating temperature.

From the results shown in FIG. 9A, it was found that, as the proportion of titanium oxide with respect to the fine alumina particles increases, the initial catalytic combustion heating temperature tends to become lower. This tendency is based on a decrease in the amount of platinum carried due to the decrease in the amount of the fine alumina particles. In cases where the proportion of titanium oxide with respect to the fine alumina particles falls within a low range of 0% by weight to 15% by weight, as the number of lighting increases, the decrease in the catalytic combustion heating temperature becomes larger. In cases where the proportion of titanium oxide with respect to the fine alumina particles is 50% by weight, the catalytic combustion heating temperature decreases sharply and the re-lighting becomes impossible after 800 times of lighting.

From the results shown in FIG. 9B, it is possible to find the degree of retention of the initial catalytic combustion heating temperature after 1,000 times of lighting. In cases where the proportion of titanium oxide with respect to the fine alumina particles falls within the range of 20% by weight to 45% by weight, no change occurs in the catalytic combustion heating temperature and the catalytic performance is not lost even after 1,000 times of lighting. On the other hand, in cases where the proportion of titanium oxide with respect to the fine alumina particles falls within the range of 0% by weight to 15% by weight, a decrease in the catalytic performance is found after 1,000 times of lighting. In cases where the proportion of titanium oxide with respect to the fine alumina particles is 50% by weight, no catalytic reaction can be obtained after 1,000 times of lighting.

However, in cases where the proportion of titanium oxide with respect to the fine alumina particles falls within the range of 10% by weight to 15% by weight, even though the catalytic combustion heating temperature decreases after 1,000 times of lighting, the retentivity of the catalytic combustion heating temperature is as high as 90% or more, and a sufficient reaction temperature is kept. In ordinary disposable gas lighters, the fuel gas runs out with approximately 600 times of lighting. Therefore, it can be judged that the catalyst member enabling 1,000 times of lighting has sufficient characteristics. Specifically, in cases where the proportion of titanium oxide with respect to the fine alumina particles falls within the range of 10% by weight to 45% by weight, a good durability with respect to rapid heating and quenching can be obtained.

From the results of the drop impact test and the lighting test, it can be found that good results can be obtained in cases where the proportion of titanium oxide with respect to the fine alumina particles falls within the range of 10% by weight to 45% by weight. It can also be found that better results can be obtained in cases where the proportion of titanium oxide with respect to the fine alumina particles falls within the range of 15% by weight to 45% by weight. Further, it can be found that even further better results can be obtained in cases where the proportion of titanium oxide with respect to the fine alumina particles falls within the range of 20% by weight to 45% by weight.

Experimental Example 3

Figure 19:
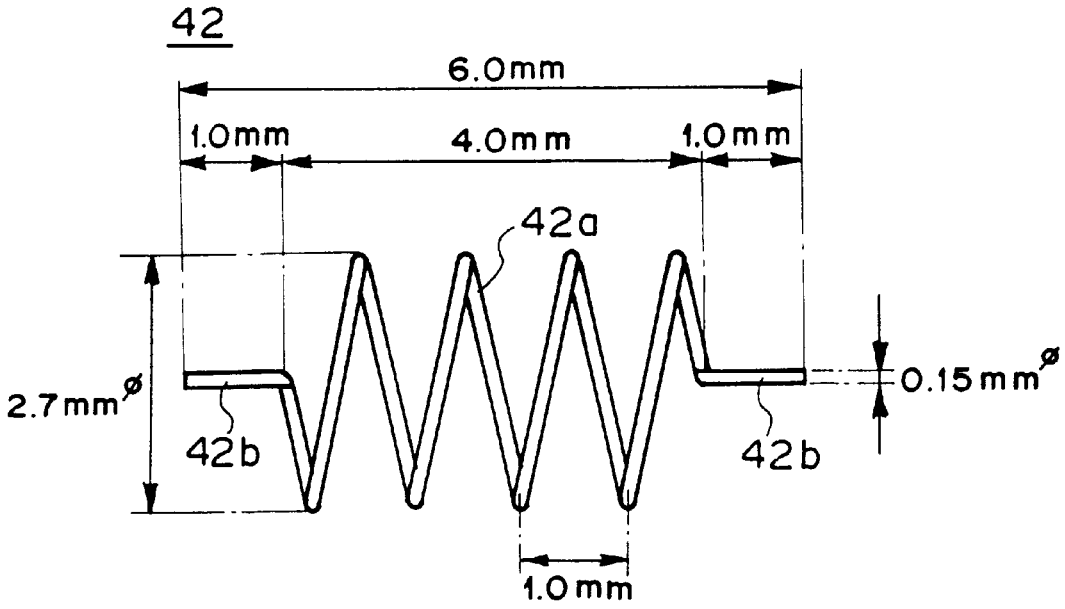
FIG. 19 is a front view showing a linear base material in an embodiment of the catalyst member for a lighter in accordance with the present invention.

As catalyst wires, a platinum wire and a catalyst member were used. The catalyst member was obtained in the manner described below. Specifically, for example, as illustrated in FIG. 19, a nichrome wire having a diameter of 0.15 mm and a length of 40 mm was coiled four turns at a pitch of 1.0 mm, and a coiled portion 42*a* having an outer diameter of 2.7 mm was thereby formed. At this time, a 38 mm middle portion of the nichrome wire was coiled in the manner described above, and linear fitting portions 42*b*, 42*b* respectively having a length of 1 mm extended from the opposite ends of the coiled portion 42*a*. In this manner, a linear base material 42 was obtained. Thereafter, the finely divided catalyst carrier, which was constituted of fine alumina particles and titanium oxide, was fusion bonded to the surface of the linear base material 42 by a low-fused powder glass. An aqueous catalyst metal salt solution, such as an aqueous chloroplatinic acid solution, was then coated on the linear base material 42 having thus been treated, and the catalyst, such as platinum, was deposited on the surface of the finely divided catalyst carrier at elevated temperature. The coiled catalyst member (catalyst wire) was thus been obtained.

The sizes and the shapes of such catalyst wires were altered in various ways. The catalyst wires were respectively fitted into gas lighters having the structure shown in FIG. 3, and their re-lighting characteristics were compared with each other by changing the gas flow rate.

In this case, the re-lighting characteristics were investigated in the manner described below. Specifically, the catalyst wire was fitted into a gas lighter, and the fuel gas was lighted. Thereafter, the fuel gas was ceased from being jetted, and the fire was thereby extinguished. The fuel gas was then jetted without a re-lighting operation by the piezo-electric unit of the gas lighter being carried out. At this time, it was investigated whether the fuel gas was or was not lighted again by the heated catalyst wire. In cases where the fuel gas was thus lighted again within three seconds after the jetting of the fuel gas was begun, it was judged that the re-lighting occurred. From the test of the re-lighting characteristics, the results shown in Tables 2, 3, and 4 were obtained. Table 2 shows the results obtained when the gas flow rate was 20 cc/minute. Table 3 shows the results obtained when the gas flow rate was 30 cc/minute. Table 4 shows the results obtained when the gas flow rate was 40 cc/minute. Ordinarily, in gas lighters, the gas flow rate of 30 cc/minute is employed. However, the gas flow rate varies in accordance with the conditions, under which the gas lighter is used, particularly the ambient temperature. Therefore, gas lighters are designed such that a change in the gas flow rate with respect to fluctuations in the temperature may be kept small. However, even if such a gas flow rate control system is employed, in cases where the temperature of the liquefied fuel gas in the gas lighter drops to a temperature as low as approximately 5° C., the equilibrium pressure of the fuel gas will decrease and the gas flow rate will inevitably become low.

In view of the above, it is necessary that the re-lighting performance can be kept even when the gas flow rate becomes low.

The results shown in (1) of Table 2, (1) of Table 3, and (1) of Table 4 were obtained when the operation for coating a 0.1% aqueous chloroplatinic acid solution on the finely divided catalyst carrier, which had been fusion bonded, and thermally decomposing the coating layer was carried out one time. The results shown in (2) of Table 2, (2) of Table 3, and (2) of Table 4 were obtained when the operation for coating a 0.1% aqueous chloroplatinic acid solution on the finely divided catalyst carrier, which had been fusion bonded, and thermally decomposing the coating layer was carried out two times. The results shown in (3) of Table 2, (3) of Table 3, and (3) of Table 4 were obtained when the operation for coating a 0.1% aqueous chloroplatinic acid solution on the finely divided catalyst carrier, which had been fusion bonded, and thermally decomposing the coating layer was carried out three times. The results shown in (4) of Table 2, (4) of Table 3, and (4) of Table 4 were obtained when a platinum wire having a diameter of 0.3 mm was used.

Figure 10:
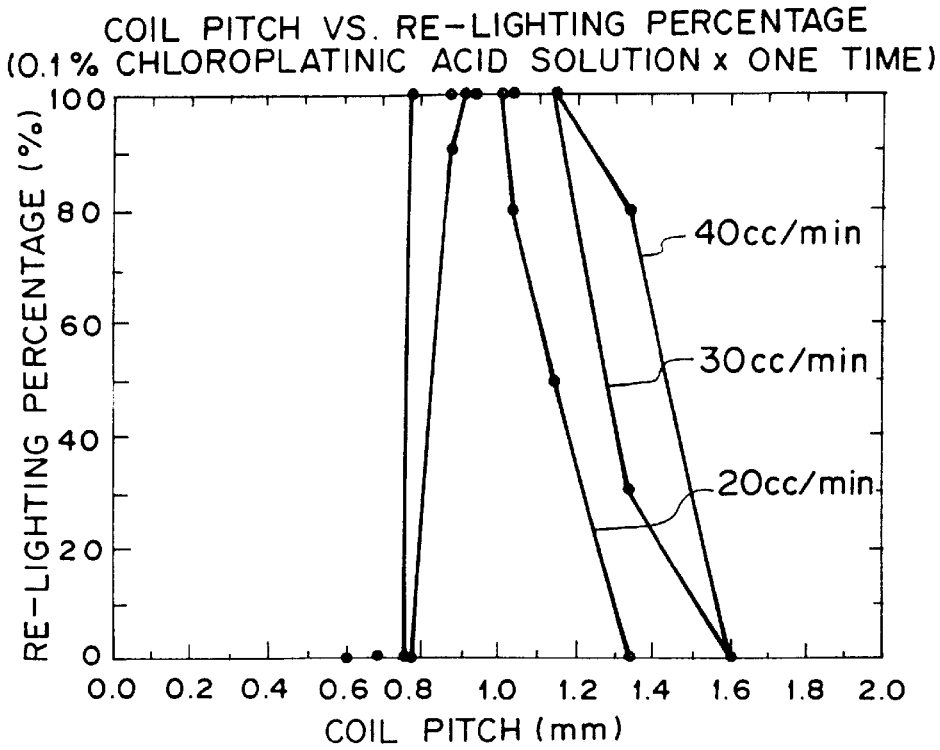
FIG. 10 is a graph showing the relationship between a coil pitch in a coiled portion of a catalyst member and a re-lighting percentage, which is obtained when a chloroplatinic acid dip-coating and thermal decomposition operation is carried out one time.
Figure 11:
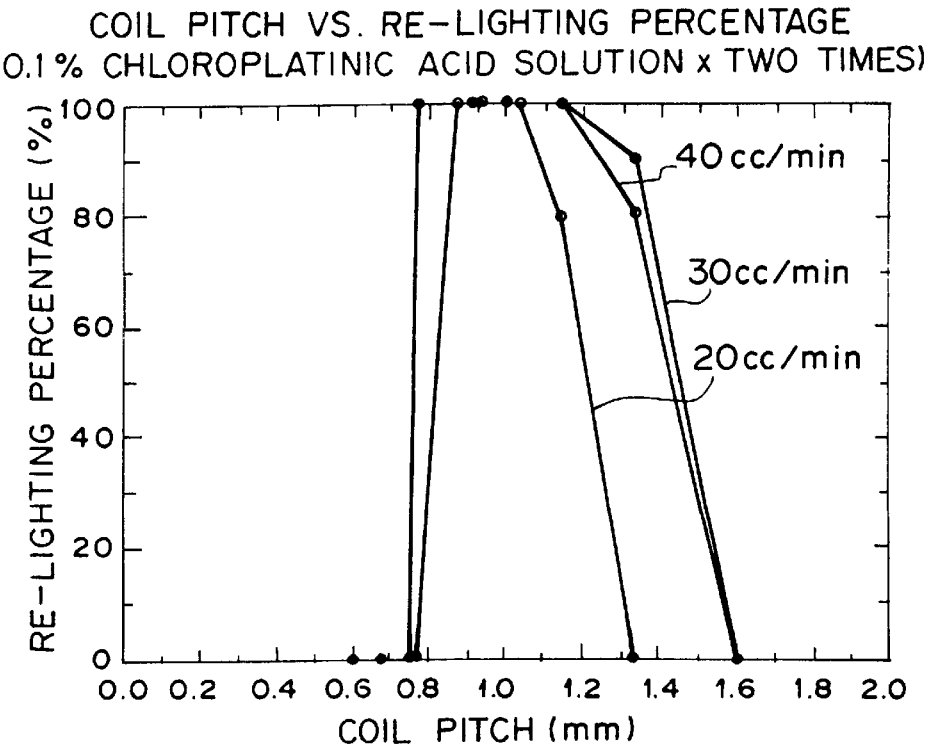
FIG. 11 is a graph showing the relationship between a coil pitch in a coiled portion of a catalyst member and a re-lighting percentage, which is obtained when a chloroplatinic acid dip-coating and thermal decomposition operation is carried out two times.
Figure 12:
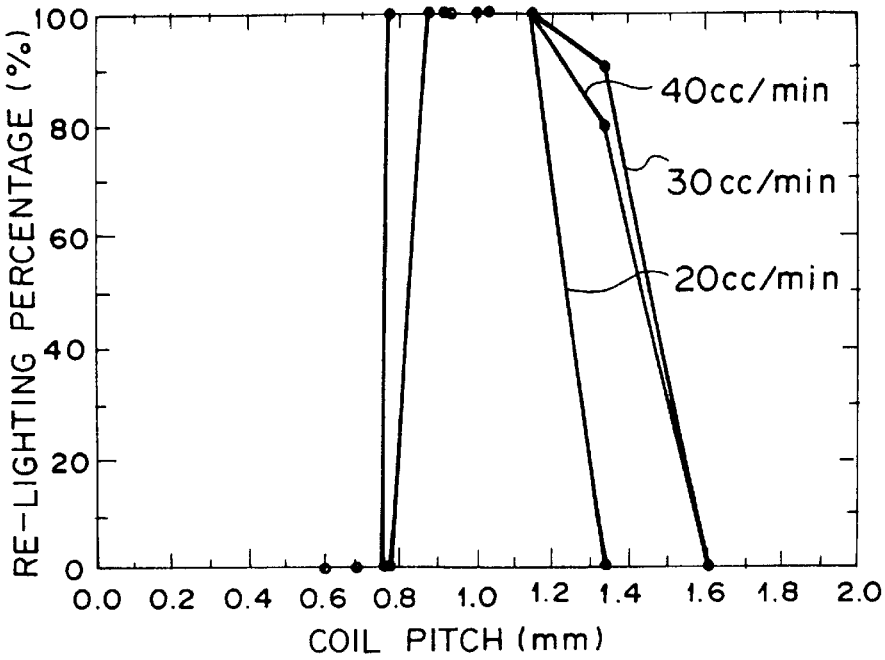
FIG. 12 is a graph showing the relationship between a coil pitch in a coiled portion of a catalyst member and a re-lighting percentage, which is obtained when a chloroplatinic acid dip-coating and thermal decomposition operation is carried out three times.

FIGS. 10, 11, and 12 provide the illustration of the results shown in Tables 2, 3, and 4.

Figure 20:
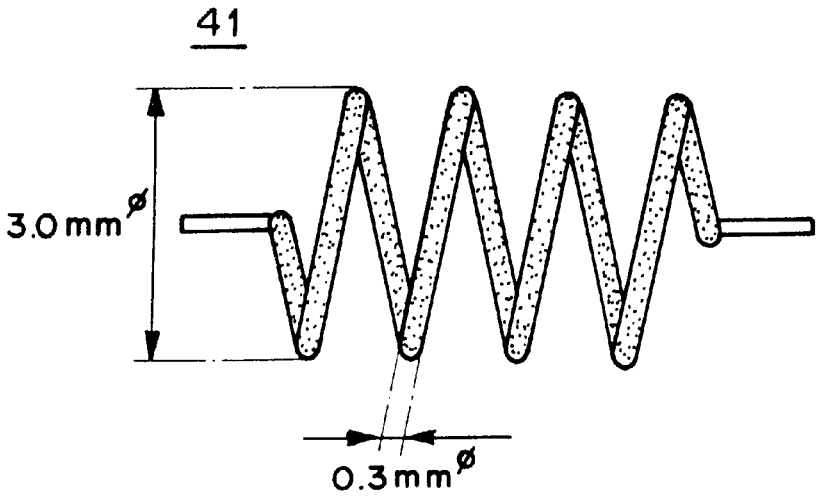
FIG. 20 is a front view showing the embodiment of the catalyst member for a lighter in accordance with the present invention, which is constituted of the linear base material shown in FIG. 19.

In these experiments, the outer diameter of the coiled portion (coil outer diameter) was set at 2.5 mm, 3.0 mm, and 3.5 mm. Also, the length of the catalyst wire was set at 30 mm to 50 mm. As illustrated in, for example, FIG. 20, the catalyst wire had a coiled shape such that the coiled portion might have a circular coil shape, and linear fitting portions respectively having a length of 1 mm might extend from the opposite ends of the coiled portion. The numbers of turns of the coiled portions and the coil pitches are listed in Tables 5 and 6. In FIGS. 10, 11, and 12, the coil pitch is plotted on the horizontal axis, and the re-lighting percentage is plotted on the vertical axis.

As illustrated in FIGS. 10, 11, and 12, when the number of the operations for coating a 0.1% aqueous chloroplatinic acid solution on the finely divided catalyst carrier, which have been fusion bonded, and thermally decomposing the coating layer is increased from one time to two times and to three times, the re-lighting percentage characteristics become better. Saturation is approximately reached in the re-lighting percentage characteristics with three such operations. Practically, the number of such operations should preferably be as small as possible. Therefore, the range, which is optimum through FIGS. 10, 11, and 12, is considered as appropriate conditions.

Also, as the gas flow rate is decreased from 40 cc/minute to 30 cc/minute and to 20 cc/minute, the re-lighting percentage range becomes narrower. Therefore, it was found that the optimum conditions should preferably be set through these results.

Thus it became possible to obtain a catalytic gas lighter having good re-lighting characteristics by setting the dimensions and the shape of the catalyst wire.

Figure 13:
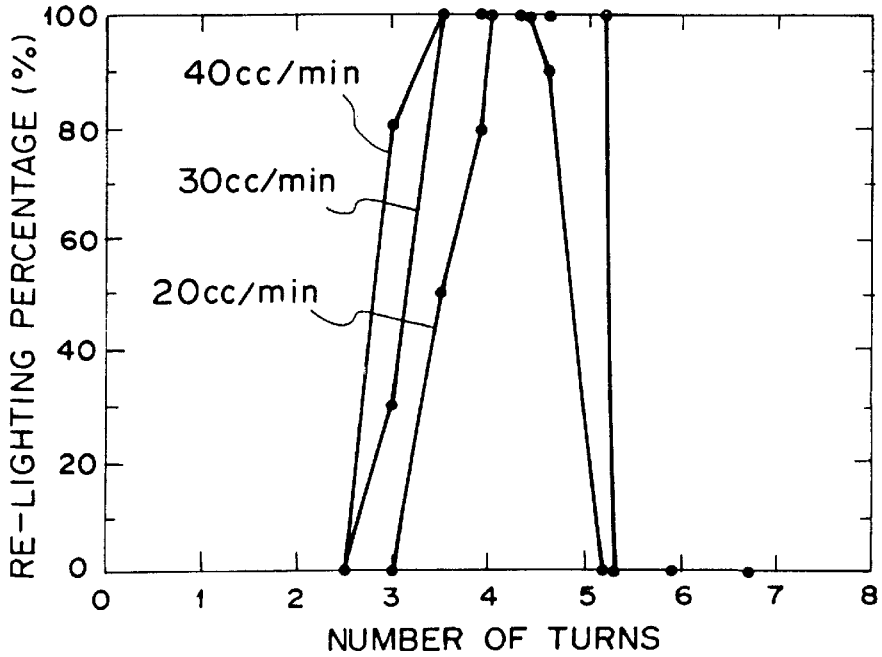
FIG. 13 is a graph showing the relationship between the number of turns in a coiled portion of a catalyst member and a re-lighting percentage, which is obtained when a chloroplatinic acid dip-coating and thermal decomposition operation is carried out one time.
Figure 14:
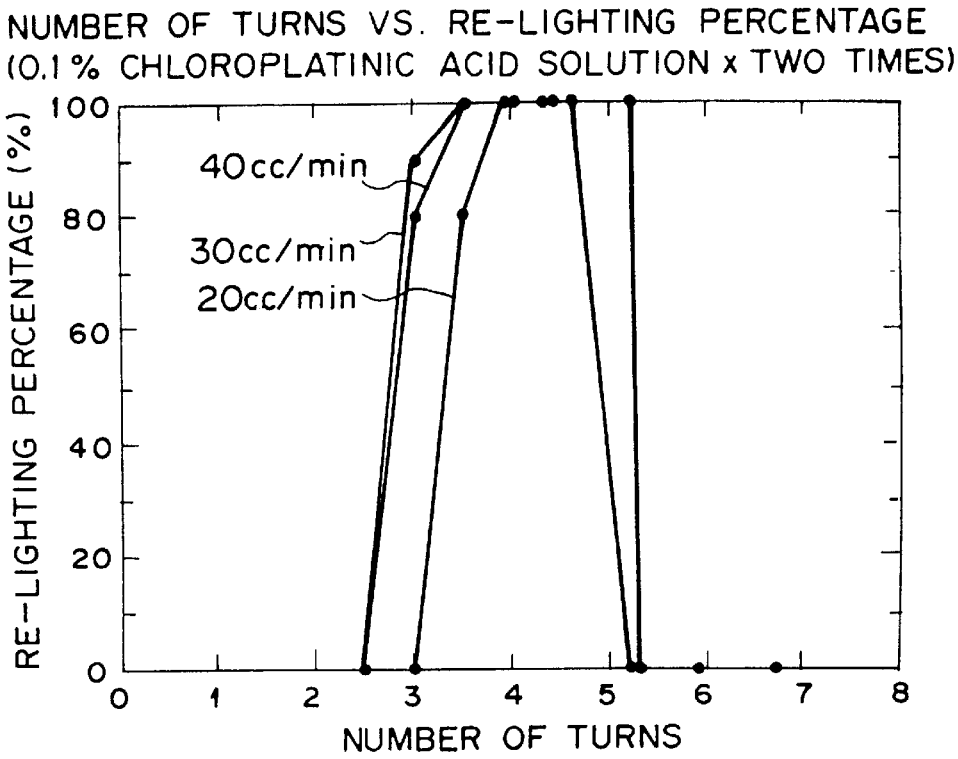
FIG. 14 is a graph showing the relationship between the number of turns in a coiled portion of a catalyst member and a re-lighting percentage, which is obtained when a chloroplatinic acid dip-coating and thermal decomposition operation is carried out two times.
Figure 15:
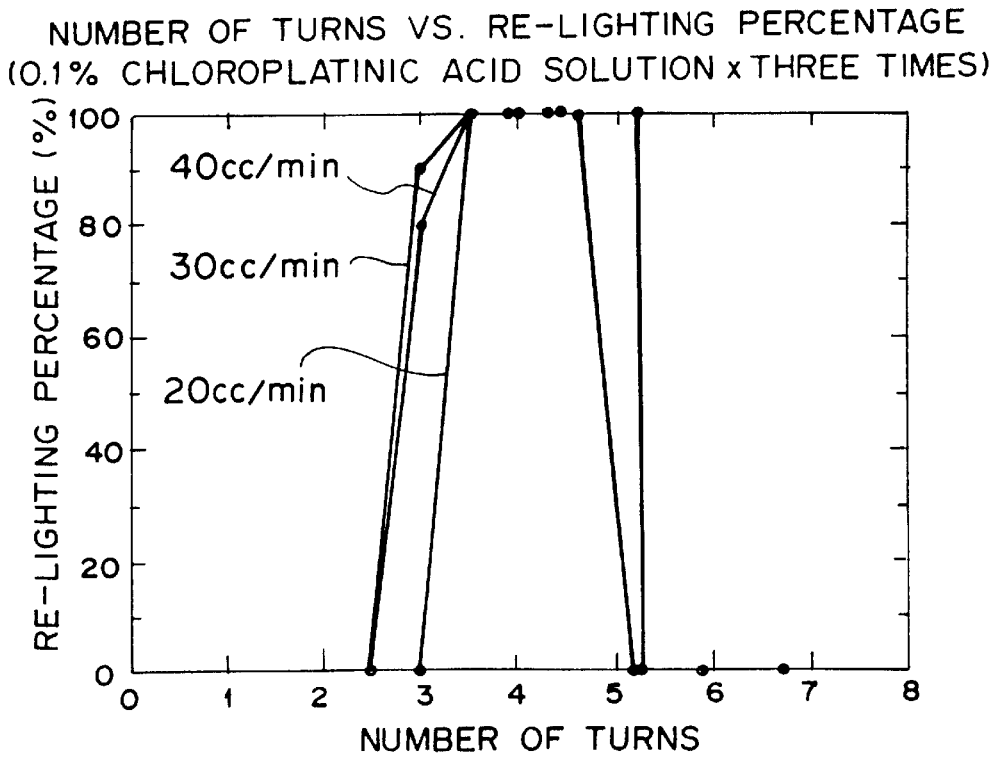
FIG. 15 is a graph showing the relationship between the number of turns in a coiled portion of a catalyst member and a re-lighting percentage, which is obtained when a chloroplatinic acid dip-coating and thermal decomposition operation is carried out three times.
Figure 16:
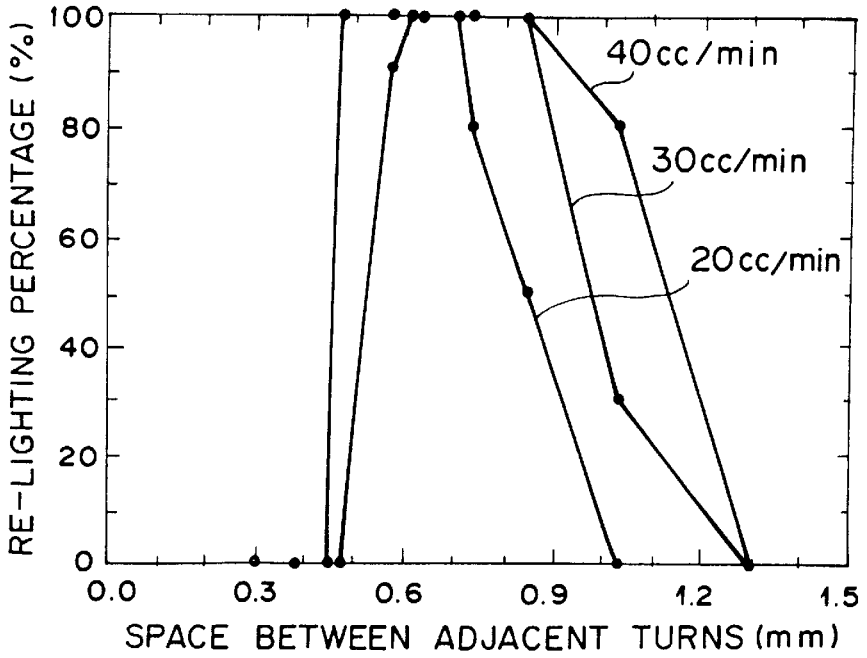
FIG. 16 is a graph showing the relationship between a re-lighting percentage and the space between adjacent turns in a coiled portion of a catalyst member, which is obtained when a chloroplatinic acid dip-coating and thermal decomposition operation is carried out one time.
Figure 17:
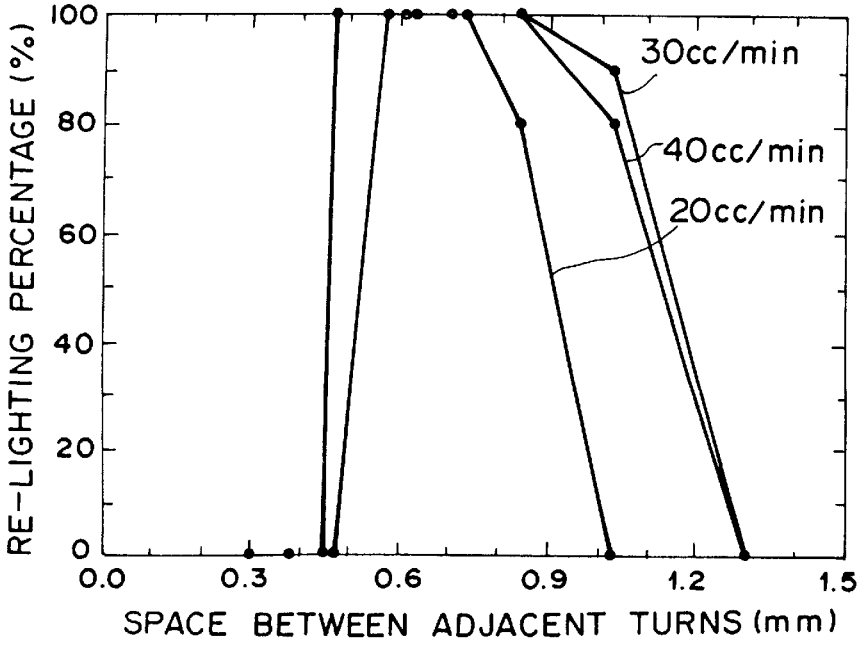
FIG. 17 is a graph showing the relationship between a re-lighting percentage and the space between adjacent turns in a coiled portion of a catalyst member, which is obtained when a chloroplatinic acid dip-coating and thermal decomposition operation is carried out two times.
Figure 18:
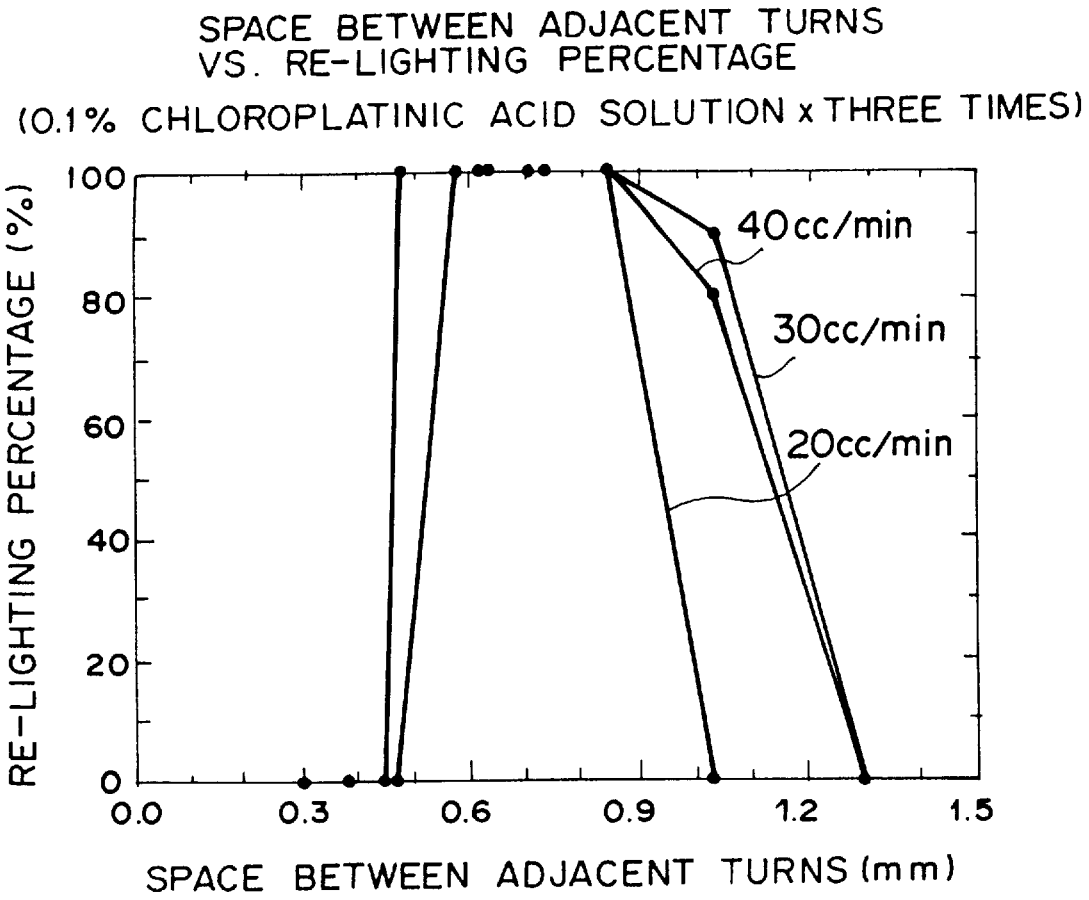
FIG. 18 is a graph showing the relationship between a re-lighting percentage and the space between adjacent turns in a coiled portion of a catalyst member, which is obtained when a chloroplatinic acid dip-coating and thermal decomposition operation is carried out three times.

FIGS. 13, 14, and 15 show the relationship between the number of turns in the coiled portion and the re-lighting percentage. FIGS. 16, 17, and 18 show the relationship between the re-lighting percentage and the space between adjacent turns in the coiled portion. The optimum range can be obtained with reference to FIGS. 16, 17, and 18.

Tables 5, 6, and 7 show the number of turns in the coiled portion, the coil pitch, and the space between adjacent turns in the coiled portion, which were employed in these experiments.

TABLE 2

| Re-lighting characteristics by coil outer diameter and catalyst wire length | | | |
|---|---|---|---|
| Coil outer diameter (mm) / Catalyst wire length (mm) | φ2.5 | φ3.0 | φ3.5 |
| • Platinum-carrying catalyst member (0.1% chloroplatinic acid solution × one time) (1) | | | |
| 30 | 0/10 | 0/10 | 0/10 |
| 35 | 10/10 | 5/10 | 0/10 |
| 40 | 0/10 | 10/10 | 0/10 |
| 45 | 0/10 | 9/10 | 8/10 |
| 50 | 0/10 | 0/10 | 0/10 |
| • Platinum-carrying catalyst member (0.1% chloroplatinic acid solution × two times) (2) | | | |
| 30 | 0/10 | 0/10 | 0/10 |
| 35 | 10/10 | 8/10 | 0/10 |
| 40 | 0/10 | 10/10 | 0/10 |
| 45 | 0/10 | 10/10 | 10/10 |
| 50 | 0/10 | 0/10 | 10/10 |
| • Platinum-carrying catalyst member (0.1% chloroplatinic acid solution × three times) (3) | | | |
| 30 | 0/10 | 0/10 | 0/10 |
| 35 | 10/10 | 10/10 | 0/10 |
| 40 | 0/10 | 10/10 | 0/10 |
| 45 | 0/10 | 10/10 | 10/10 |
| 50 | 0/10 | 0/10 | 10/10 |
| • Platinum wire (wire diameter: 0.3 mm) (4) | | | |
| 30 | 10/10 | 0/10 | 0/10 |
| 35 | 10/10 | 9/10 | 6/10 |
| 40 | 0/10 | 10/10 | 10/10 |
| 45 | 0/10 | 10/10 | 10/10 |
| 50 | 0/10 | 10/10 | 10/10 |

• Gas flow rate 20 cc/min
• Carrier used $Al_2O_3$ 80% $TiO_2$ 20% Glass frit 2%
• Carrier particle diameter $Al_2O_3$ 0.3 μm $TiO_2$ 0.6~0.8 μm

TABLE 3

| Re-lighting characteristics by coil outer diameter and catalyst wire length | | | |
|---|---|---|---|
| Coil outer diameter (mm) / Catalyst wire length (mm) | ϕ2.5 | ϕ3.0 | ϕ3.5 |
| • Platinum-carrying catalyst member (0.1% chloroplatinic acid solution × one time) (1) | | | |
| 30 | 10/10 | 0/10 | 0/10 |
| 35 | 10/10 | 9/10 | 3/10 |
| 40 | 0/10 | 10/10 | 10/10 |
| 45 | 0/10 | 10/10 | 10/10 |
| 50 | 0/10 | 10/10 | 10/10 |
| • Platinum-carrying catalyst member (0.1% chloroplatinic acid solution × two times) (2) | | | |
| 30 | 10/10 | 0/10 | 0/10 |
| 35 | 10/10 | 10/10 | 9/10 |
| 40 | 0/10 | 10/10 | 10/10 |
| 45 | 0/10 | 10/10 | 10/10 |
| 50 | 0/10 | 10/10 | 10/10 |
| • Platinum-carrying catalyst member (0.1% chloroplatinic acid solution × three times) (3) | | | |
| 30 | 10/10 | 0/10 | 0/10 |
| 35 | 10/10 | 10/10 | 9/10 |
| 40 | 0/10 | 10/10 | 10/10 |
| 45 | 0/10 | 10/10 | 10/10 |
| 50 | 0/10 | 10/10 | 10/10 |
| • Platinum wire (wire diameter: 0.3 mm) (4) | | | |
| 30 | 10/10 | 0/10 | 0/10 |
| 35 | 10/10 | 10/10 | 9/10 |
| 40 | 1/10 | 10/10 | 10/10 |
| 45 | 0/10 | 10/10 | 10/10 |
| 50 | 0/10 | 10/10 | 10/10 |

• Gas flow rate 30 cc/min
• Carrier used $Al_2O_3$ 80% $TiO_2$ 20% Glass frit 2%
• Carrier particle diameter $Al_2O_3$ 0.3 $\mu$m $TiO_2$ 0.6~0.8 $\mu$m

TABLE 4

| Re-lighting characteristics by coil outer diameter and catalyst wire length | | | |
|---|---|---|---|
| Coil outer diameter (mm) / Catalyst wire length (mm) | ϕ2.5 | ϕ3.0 | ϕ3.5 |
| • Platinum-carrying catalyst member (0.1% chloroplatinic acid solution × one time) (1) | | | |
| 30 | 10/10 | 0/10 | 0/10 |
| 35 | 10/10 | 8/10 | 6/10 |
| 40 | 0/10 | 10/10 | 10/10 |
| 45 | 0/10 | 10/10 | 10/10 |
| 50 | 0/10 | 10/10 | 10/10 |
| • Platinum-carrying catalyst member (0.1% chloroplatinic acid solution × two times) (2) | | | |
| 30 | 10/10 | 0/10 | 0/10 |
| 35 | 10/10 | 10/10 | 8/10 |
| 40 | 0/10 | 10/10 | 10/10 |
| 45 | 0/10 | 10/10 | 10/10 |
| 50 | 0/10 | 10/10 | 10/10 |

TABLE 4-continued

| Re-lighting characteristics by coil outer diameter and catalyst wire length | | | |
|---|---|---|---|
| Coil outer diameter (mm) / Catalyst wire length (mm) | ϕ2.5 | ϕ3.0 | ϕ3.5 |
| • Platinum-carrying catalyst member (0.1% chloroplatinic acid solution × three times) (3) | | | |
| 30 | 10/10 | 0/10 | 0/10 |
| 35 | 10/10 | 10/10 | 8/10 |
| 40 | 0/10 | 10/10 | 10/10 |
| 45 | 0/10 | 10/10 | 10/10 |
| 50 | 0/10 | 10/10 | 10/10 |
| • Platinum wire (wire diameter: 0.3 mm) (4) | | | |
| 30 | 10/10 | 0/10 | 0/10 |
| 35 | 10/10 | 10/10 | 9/10 |
| 40 | 10/10 | 10/10 | 10/10 |
| 45 | 0/10 | 10/10 | 10/10 |
| 50 | 0/10 | 10/10 | 10/10 |

• Gas flow rate 40 cc/min
• Carrier used $Al_2O_3$ 80% $TiO_2$ 20% Glass frit 2%
• Carrier particle diameter $Al_2O_3$ 0.3 $\mu$m $TiO_2$ 0.6~0.8 $\mu$m

TABLE 5

| Number of turns by coil outer diameter and catalyst wire length | | | |
|---|---|---|---|
| Coil outer diameter (mm) / Catalyst wire length (mm) | ϕ2.5 | ϕ3.0 | ϕ3.5 |
| 30 | 3.5 turns | 3.0 turns | 2.5 turns |
| 35 | 4.4 turns | 3.5 turns | 3.0 turns |
| 40 | 5.3 turns | 4.0 turns | 3.5 turns |
| 45 | 5.9 turns | 4.6 turns | 3.9 turns |
| 50 | 6.7 turns | 5.2 turns | 4.3 turns |

TABLE 6

| Coil pitch by coil outer diameter and catalyst wire length | | | |
|---|---|---|---|
| Coil outer diameter (mm) / Catalyst wire length (mm) | ϕ2.5 | ϕ3.0 | ϕ3.5 |
| 30 | 1.14 mm | 1.33 mm | 1.60 mm |
| 35 | 0.91 mm | 1.14 mm | 1.33 mm |
| 40 | 0.75 mm | 1.00 mm | 1.14 mm |
| 45 | 0.68 mm | 0.87 mm | 1.03 mm |
| 50 | 0.60 mm | 0.77 mm | 0.93 mm |

TABLE 7

| Space between adjacent turns by coil outer diameter and catalyst wire length | | | |
|---|---|---|---|
| Coil outer diameter (mm) Catalyst wire length (mm) | ϕ2.5 | ϕ3.0 | ϕ3.5 |
| 30 | 0.84 mm | 1.03 mm | 1.30 mm |
| 35 | 0.61 mm | 0.84 mm | 1.03 mm |
| 40 | 0.45 mm | 0.70 mm | 0.84 mm |
| 45 | 0.38 mm | 0.57 mm | 0.73 mm |
| 50 | 0.30 mm | 0.47 mm | 0.63 mm |

EXAMPLE 5

A nichrome wire having a diameter of 0.15 mm and a length of 40 mm was coiled four turns at a pitch of 1.0 mm, and a coiled portion having an outer diameter of 2.7 mm was thereby formed. In this manner, a linear base material was obtained. A mixture was prepared by mixing 80% of fine alumina particles and 20% of titanium oxide with each other, and 4% of low-fused powder glass was added to the mixture. A polyvinyl alcohol was then added to the obtained mixture, and a viscous liquid was thereby obtained. Thereafter, approximately 3 mg of the viscous liquid was coated onto the surface of the coiled portion of the linear base material. The applied viscous liquid layer was dried at normal temperatures and heated at 300° C. for 15 minutes, and the polyvinyl alcohol was thereby removed. The linear base material having thus been treated was then heated at 1,240° C. for 10 minutes. In this manner, a catalyst carrier wire was obtained. The catalyst carrier wire was then dip coated three times with a 0.1% aqueous chloroplatinic acid solution. The dip-coating layer was then heated and thermally decomposed at 800° C. for 10 minutes. Thus platinum particles were deposited on the surface of the catalyst carrier wire, and a catalyst member (catalyst wire) was obtained.

The obtained catalyst member was fitted and secured at the top end of the combustion pipe 26 of the gas lighter 10 shown in FIG. 3. The fuel gas flow rate in the gas lighter was set at 30 cc/minute. In this manner, a catalytic gas lighter was produced.

As performance evaluation tests of the catalyst wire produced in the manner described above, a drop impact test, a bonding strength test, a re-lighting percentage test, and a re-lighting service life test were carried out.

Figure 21:
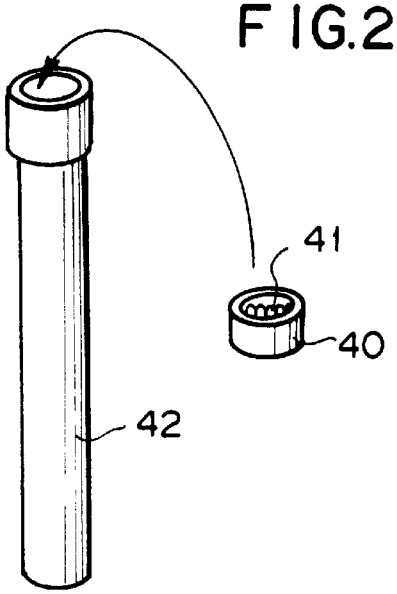
FIG. 21 is an explanatory view showing how a drop impact test is carried out.

In the drop impact test, as illustrated in FIG. 21, a catalyst wire 41 was fitted into a sample holder 40. The sample holder 40, in which the catalyst wire 41 has been fitted, was then fitted into a cylindrical fixture 42 shown in FIG. 21 for the drop impact test. The cylindrical fixture 42 was then dropped from a height of 1.5 m onto a concrete block with the catalyst wire side facing down. The dropping step was repeated ten times, and the drop impact was thereby given to the catalyst wire. Thereafter, the amount of the finely divided catalyst carrier, which had come off the catalyst wire, was measured.

When the drop impact test was carried out in this manner on the catalyst wire, the finely divided catalyst carrier did not come off the catalyst wire. It was thus confirmed that this catalyst wire had a sufficient strength against drop impacts.

Figure 22:
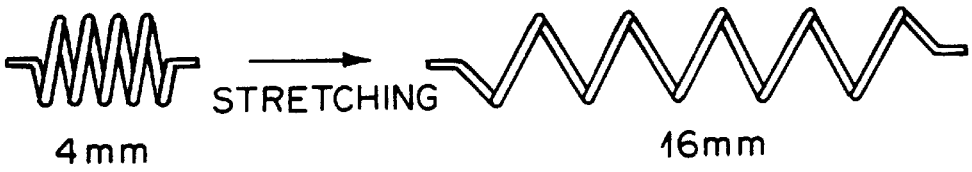
FIG. 22 is an explanatory view showing how a bonding strength test is carried out.

In the bonding strength test, in order to investigate the bonding strength of the finely divided catalyst carrier to the nichrome wire, the coiled catalyst wire was stretched, and the weight of the finely divided catalyst carrier, which had come off the nichrome wire, was measured. Specifically, as illustrated in FIG. 22, the catalyst wire having a length of the coiled portion of 4 mm was stretched such that the length of the coiled portion might become equal to 16 mm. During the stretching operation, the weight of the finely divided catalyst carrier, which had come off the nichrome wire.

When the bonding strength test was carried out in this manner on the catalyst wire, the finely divided catalyst carrier did not come off the catalyst wire.

Figure 23:
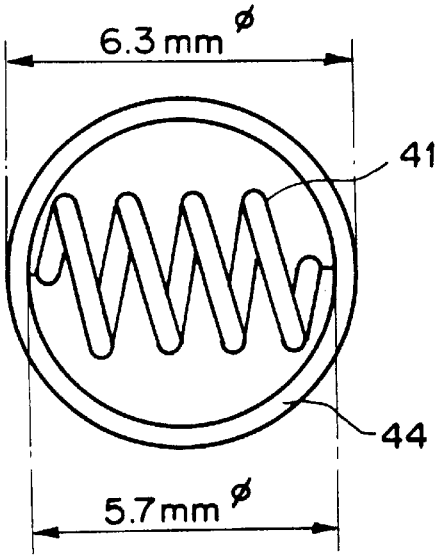
FIG. 23 is a plan view showing a frame, to which an experimental sample of a catalyst member is fitted in a re-lighting percentage test in Example 5.

In the relighting percentage test, the catalyst wire 41 was fitted into a frame 44 shown in FIG. 23. The frame 44, in which the catalyst wire had thus been fitted, was then fitted into the gas lighter shown in FIG. 3, in which the gas flow rate was set at 30 cc/minute. The fuel gas was lighted in the gas lighter. After one second, the fire was extinguished. One second after the fire was thus extinguished, the fuel gas was jetted without a lighting operation by the piezo-electric unit being carried out. At this time, it was investigated whether a flame is or is not produced again within three seconds by the catalytic performance of the catalyst wire. This cycle was repeated ten times.

When the re-lighting percentage test was carried out in this manner on the catalyst wire, it was confirmed that re-lighting occurred within three seconds in all of ten cycles of test. Thus the a re-lighting percentage of 100% was obtained.

In the re-lighting service life test, the catalyst wire was fitted into the gas lighter in the same manner as that in the re-lighting percentage test. In the gas lighter, the cycle of lighting for approximately one second and fire extinguishment for approximately one second was repeated 1,000 times. Thermal shocks were given to the catalyst wire in this manner, and it was investigated whether the re-lighting performance was or was not obtained.

When the re-lighting service life test was carried out on the catalyst wire in this manner, re-lighting was possible within three seconds even after 1,000 test cycles. Thus it was found that the catalyst wire had a sufficient re-lighting service life.

What is claimed is:

1. A gas lighter having a catalyst member for promoting reignition of fuel gas comprising:

a gas lighter having a combustion chamber; and a catalyst member disposed in the combustion chamber comprising:

i) a linear base material, ii) a fusion bonding material, which is constituted of a material selected from the group consisting of a powdered metal and vitreous fused material, iii) a finely divided catalyst carrier, which is constituted of a metal oxide and is secured to the surface of said linear base material by said fusion bonding material, and iv) a catalyst, which is deposited on the surface of said finely divided catalyst carrier so as to promote reignition of lighter fuel gas in the combustion chamber.

2. A catalyst member as defined in claim 1 wherein said linear base material is constituted of a nickel-chrome alloy wire.

3. A catalyst member as defined in claim 1 wherein said powdered metal, which serves as said fusion bonding material, is selected from the group consisting of a mixed powder of nickel powder and chrome powder; a mixed powder of nickel powder, chrome powder, and a rare earth metal; and a mixed powder of nickel powder, chrome powder, and metallic silicon.

4. A catalyst member as defined in claim 1 wherein said vitreous fused material, which serves as said fusion bonding material, is a fused powder glass.

5. A catalyst member as defined in claim 1 wherein said finely divided catalyst carrier is constituted of fine alumina particles.

6. A catalyst member as defined in claim 1 wherein said finely divided catalyst carrier is a mixed powder of fine alumina particles and titanium oxide.

7. A catalyst member as defined in claim 6 wherein the proportion of the titanium oxide falls within the range of 10% by weight to 45% by weight with respect to said fine alumina particles.

8. A catalyst member as defined in claim 1 wherein said linear base material is constituted of a nickel-chrome alloy wire, fine particles, which are selected from the group consisting of nickel oxide powder, chromium oxide powder, and mixed powder of nickel oxide and chromium oxide, are fusion bonded to the surface of said linear base material, which is constituted of the nickel-chrome alloy wire, by said fusion bonding material, which is selected from the group consisting of a mixed powder of nickel and chrome; a mixed powder of nickel, chrome, and a rare earth metal; and a mixed powder of nickel, chrome, and metallic silicon, and said fusion bonded fine particles, which are selected from the group consisting of nickel oxide powder, chromium oxide powder, and mixed powder of nickel oxide and chromium oxide, constitute said finely divided catalyst carrier.

9. A gas lighter having a catalyst member for promoting reignition of fuel gas comprising:

a gas lighter having a combustion chamber; and a catalyst member disposed in the combustion chamber comprising:

i) a linear base material, ii) a catalyst carrier, which is formed on the surface of said linear base material, and is constituted of fine metal particles, said fine metal particles being constituted of a powdered metal having been fusion bonded to the surface of said linear base material, and iii) a catalyst, which is deposited on the surface of said catalyst carrier so as to promote reignition of lighter fuel gas in the combustion chamber.

10. A catalyst member as defined in claim 9 wherein said linear base material is constituted of a nickel-chrome alloy wire, and said fine metal particles, which are fusion bonded to the surface of said linear base material, is selected from the group consisting of a mixed powder of nickel and chrome; a mixed powder of nickel, chrome, and a rare earth metal; and a mixed powder of nickel, chrome, and metallic silicon.

11. A process for producing a gas lighter having a catalyst member for promoting fuel gas reignition comprising the steps of:

i) fusion bonding a finely divided catalyst carrier, which is constituted of a metal oxide, to the surface of a linear base material by a fusion bonding material, which is constituted of a material selected from the group consisting of a powdered metal and a vitreous fused material, ii) applying a catalyst solution to the surface of said finely divided catalyst carrier, and iii) thermally decomposing said catalyst solution, which has been applied to the surface of said finely divided catalyst carrier, a catalyst being thereby deposited on the surface of said finely divided catalyst carrier; and iv) installing the linear base material having the deposited catalyst in a combustion chamber of a gas lighter so as to promote reignition of lighter fuel gas in the combustion chamber.

12. A process as defined in claim 11 wherein said catalyst solution is an aqueous chloroplatinic acid solution.

* * * * *